US005572739A

United States Patent [19]

Kolada et al.

[11] Patent Number: 5,572,739

[45] **Date of Patent: * Nov. 12, 1996**

[54] BALL GLOVE

[75] Inventors: Paul P. Kolada, Bexley; Terry M. Birchler, Westerville, both of Ohio

[73] Assignee: Priority Designs, Inc., Gahanna, Ohio

[ * ] Notice: The term of this patent shall not extend beyond the expiration date of Pat. No. 5,402,537.

[21] Appl. No.: 148,834

[22] Filed: Nov. 5, 1993

Related U.S. Application Data

[63] Continuation-in-part of Ser. No. 916,477, Jul. 20, 1992, Pat. No. 5,402,537.

[51] Int. Cl.[6] ..... A41D 13/10

[52] U.S. Cl. ..... 2/19; 2/161.1; 2/167; 2/168

[58] Field of Search ..... 2/16, 19, 158, 2/159, 160, 161.1, 161.2, 161.3, 161.8, 164, 167, 168, DIG. 1

[56] References Cited

U.S. PATENT DOCUMENTS

| | | | |
|---|---|---|---|
| 3,404,409 | 10/1968 | Tillotson et al. | 2/167 |
| 3,600,716 | 8/1971 | Berry | 2/167 |
| 4,279,681 | 7/1981 | Klimezky | 2/19 |
| 4,665,561 | 5/1987 | Aoki | 2/19 |
| 4,891,845 | 1/1990 | Hayes | 2/19 |
| 4,896,376 | 1/1990 | Miner | 2/19 |
| 5,402,537 | 4/1995 | Kolada | 2/19 |

FOREIGN PATENT DOCUMENTS

| | | | |
|---|---|---|---|
| 427688 | 11/1947 | Italy | 2/159 |
| 670862 | 4/1952 | United Kingdom | 2/161.1 |
| 1202567 | 8/1970 | United Kingdom | 2/159 |
| 2028632 | 3/1980 | United Kingdom | 2/168 |

*Primary Examiner*—Diana Biefeld

*Attorney, Agent, or Firm*—Frank H. Foster; Kremblas, Foster, Millard & Pollick

[57] ABSTRACT

A ball glove having a plurality of generally axially oriented ridges, protruding outwardly from the frontal surface of the glove. The ridges extend from the proximal edge to the distal, peripheral edge of the glove and have protrusions formed near the finger tips. The protrusions taper gradually at their distal end and have a shoulder formed at their proximal ends. The glove has a glove-like handpiece removably attached to a shell. The shell includes a plurality of generally axially oriented, flexible, elongated ribs corresponding to the thumb and fingers of the wearer, and an elastomeric polymer skin which is more flexible than the ribs and is conformingly attached to the ribs.

29 Claims, 19 Drawing Sheets

BALL GLOVE

This application is a continuation-in-part of Ser. No. 07/916,477, filed Jul. 20, 1992 which is now U.S. Pat. No. 5,402,537.

TECHNICAL FIELD

This invention relates to baseball gloves and more particularly relates to a baseball glove formed by molding plastic.

BACKGROUND ART

Baseball and softball gloves are conventionally made from leather and, as a result, are expensive and somewhat limited in the range of the variability of their functional and aesthetic design, manufacture and use. A typical ball glove has five thick, leather finger tubes extending outwardly from a flat, padded palm region. Four leather finger tubes are laced together, and a web connects a thumb finger tube to the other four finger tubes.

Leather ball gloves need what is known as a "break-in period" before they are optimally suited for use. The break-in period is the time during which the stiffness of the new leather glove is reduced by repeatedly flexing and chemically treating the glove to soften the leather, define lines of flexure and improve the fit and performance for the owner of the glove. The requirement of a leather glove to be broken in not only delays the use of a new leather glove, but also demonstrates that if the ball glove changes from the time it is new until the time it is broken in, then the ball glove is constantly changing during use, even after it is broken in. This constant variation of the glove is undesirable, since most athletes want their equipment to remain consistent in its performance so the athletes can depend upon its consistency, and concentrate on varying and improving their performance in order to attain optimum overall results.

The thickness of the leather required to make the glove structurally suitable inhibits any passages of air to the hand of the user. Any small air passages formed in the thick leather will allow little air to be passed to the user's hand by virtue of the long tunnel the air must traverse to contact the hand.

The typical leather glove is made by connecting a large number of leather pieces into an arranged shape. The pieces of leather must each be cut out or formed into a shape, sewn and laced together, and treated to preserve the leather. A large number of manufacturing steps are required to make a conventional leather ball glove, making the expense high. Variations in the qualities of leather introduce a large possibility for flaws in the finished glove.

The damage that occurs when leather becomes wet from water and later dries out is well known and is another problem with conventional leather ball gloves, especially those with inferior leather. The weight and physical structure necessary for forming a leather ball glove that will not only hold itself rigid under its own weight, but will also maintain its general overall shape upon impact of a ball being caught, also add to the disadvantages of leather ball gloves.

Another problem with conventional leather ball gloves is the difficulty of conforming the ball glove to any shape other than its open or closed shape. For example, when fielding a ball rolling on the ground, a player opens the leather glove and presses the finger tip end of the glove against the ground to give the ball a "ramp" from the ground up into the glove.

Most conventional ball gloves provide only a small portion of the finger tip end of the glove along which the glove forms a ramp upon being pressed to the ground. Additionally, the thickness of the finger tubes provides an abrupt bump for the ball when rolling into contact with and onto the "ramp" the glove forms.

Attempts have been made to alleviate some of the problems of conventional leather ball gloves. Miner, in U.S. Pat. No. 4,896,376, uses shaped sheets of plastic which are sewn and riveted together to form a ball glove. The ball glove is weather proof, but the large number of manufacturing steps involved would require Miner's ball glove to be as expensive and as complex as a conventional leather ball glove.

Klimezky, in U.S. Pat. No. 4,279,681, describes a method called slush molding that is used to make a leather look-alike ball glove. This method includes pouring a liquid or powdered plastic into a heated mold and solidifying an outer shell. The liquid or powder that is not solidified is dumped and the shell is removed from the mold. As a second step, the finger holes are defined by forming spaced, linear welds that separate hollow cavities into which fingers are inserted by the user.

Injection molding involves pouring or forcing liquid into a cavity and then allowing the liquid to assume the shape of the cavity and solidify. Injection molding is well known, and has been used to form the soft plastic parts of gas masks and swim fins. Swim fins often have multiple plastics of different physical properties, such as hardness, molded together in a series of steps or molded separately and later assembled. However, baseball gloves have never been designed to utilize and accommodate plastic material characteristics and injection molding techniques. Instead, baseball gloves are all modelled after the conventional leather ball glove and their manufacturing methods.

The method of manufacturing Klimezky's ball glove is simpler than that used to manufacture conventional leather ball gloves and is also simpler than that used to manufacture Miner's ball glove. Additionally, Klimezky's ball glove would be weather proof if constructed of correctly selected materials. However, Klimezky emphasizes that it is of primary importance that his ball glove have very similar appearance to a leather ball glove. Klimezky also mentions that his glove is as good as a leather glove. The utility of a leather glove is in need of improvement, as discussed above and below.

One of the more prominent disadvantages of conventional leather ball gloves, and Klimezky and Miner's ball gloves, is that once the gloves are manufactured, there is little opportunity provided for variations in the size and shape of the hand of the person using the glove. Typically, a glove which is large can only be used by someone having a large hand, particularly long fingers. Klimezky's glove has a cavity in it into which a person's hand is inserted. If a small person wants to purchase a large glove made by Klimezky's method, the small person must insert his hand into the cavity and operate the glove regardless of the shape and size of his hand, with no provision for adjustment. Leather gloves have finger straps which can be loosened or tightened slightly, but the conventional leather glove still has finger tubes that are not variable in depth or diameter. Also, if an owner of a glove "breaks in" a leather glove, it is usually uncomfortable for a second person to use the glove, due to the leather having conformed to the owner's hand and the owner's flexure regions.

Therefore, there is a need for an improved ball glove that can be simply and inexpensively manufactured, is weather proof and consistent in its performance, and can be varied extensively after manufacture to fit various hand shapes and sizes. The ball glove should allow for design variability to allow it to be tailored before and after manufacture to the variations in hands and in fielding needs at different baseball or softball positions.

BRIEF DISCLOSURE OF INVENTION

The invention is a baseball or softball glove comprising a flexible, plastic shell. The plastic shell is molded into a curved, concave, frontal contour forming a ball-receiving surface and a rear surface. The ball glove further comprises a hand receiving handpiece, attached to the rear of the shell along finger regions.

An improved embodiment of the invention includes a plurality of generally axially oriented ridges protruding outwardly from the frontal surface of the glove and extending to near the distal, peripheral edge of the glove. The preferred ridges have ball retaining protrusions extending outwardly further than the contiguous portion of the ridges. The protrusions taper at their distal end toward the distal peripheral edge of the glove and have a shoulder formed at their proximal end for retaining the ball in the glove. A plurality of generally, axially oriented, flexible, elongated ribs are positioned in thumb and finger regions of the glove, the ribs having a curved surface contour. A skin, which is more flexible than the ribs, is conformingly attached to the ribs and forms a frontal surface, a hand-receiving opening and finger-receiving cavities of the glove. A variety of other improved structural features have also been added to the improved glove.

BRIEF DESCRIPTION OF DRAWINGS

FIG. 1A illustrates a detail of FIG. 1.

FIG. 2A shows the skin portion and FIG. 2B shows the skeleton portion of the shell.

Figure 1:
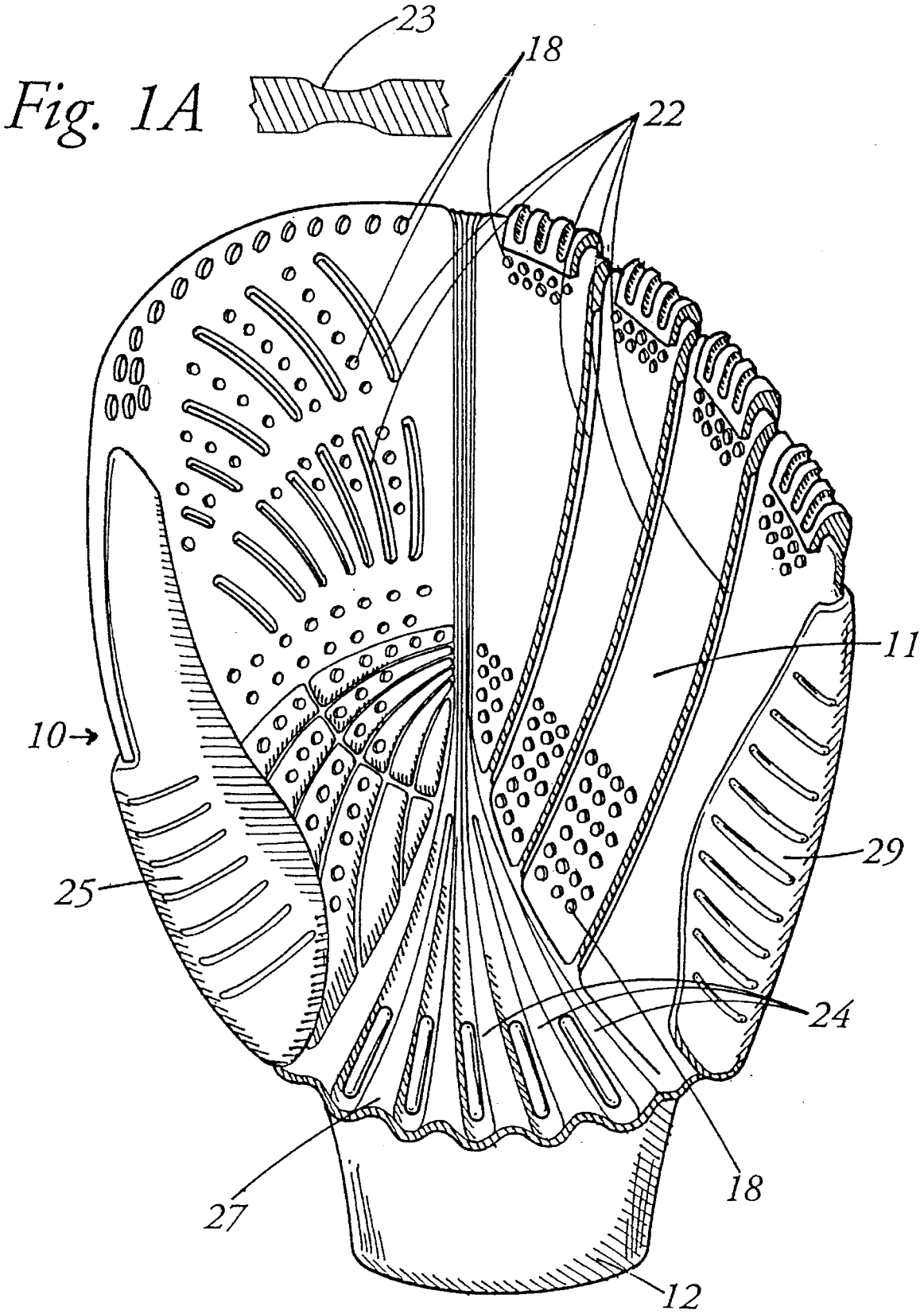
FIG. 1 is a frontal view in perspective illustrating the preferred embodiment of the present invention.

In describing the preferred embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose. For example, the word connected or terms similar thereto are often used. They are not limited to direct connection but include connection through other elements where such connection is recognized as being equivalent by those skilled in the art.

DETAILED DESCRIPTION

The preferred embodiment of the present invention illustrated in FIG. 1 consists of a shell 10 attached to a handpiece 12. The shell 10 has a concave, ball-receiving, frontal surface 11, and a convex rear surface (not visible in FIG. 1) to which the handpiece 12 attaches.

Figure 2A:
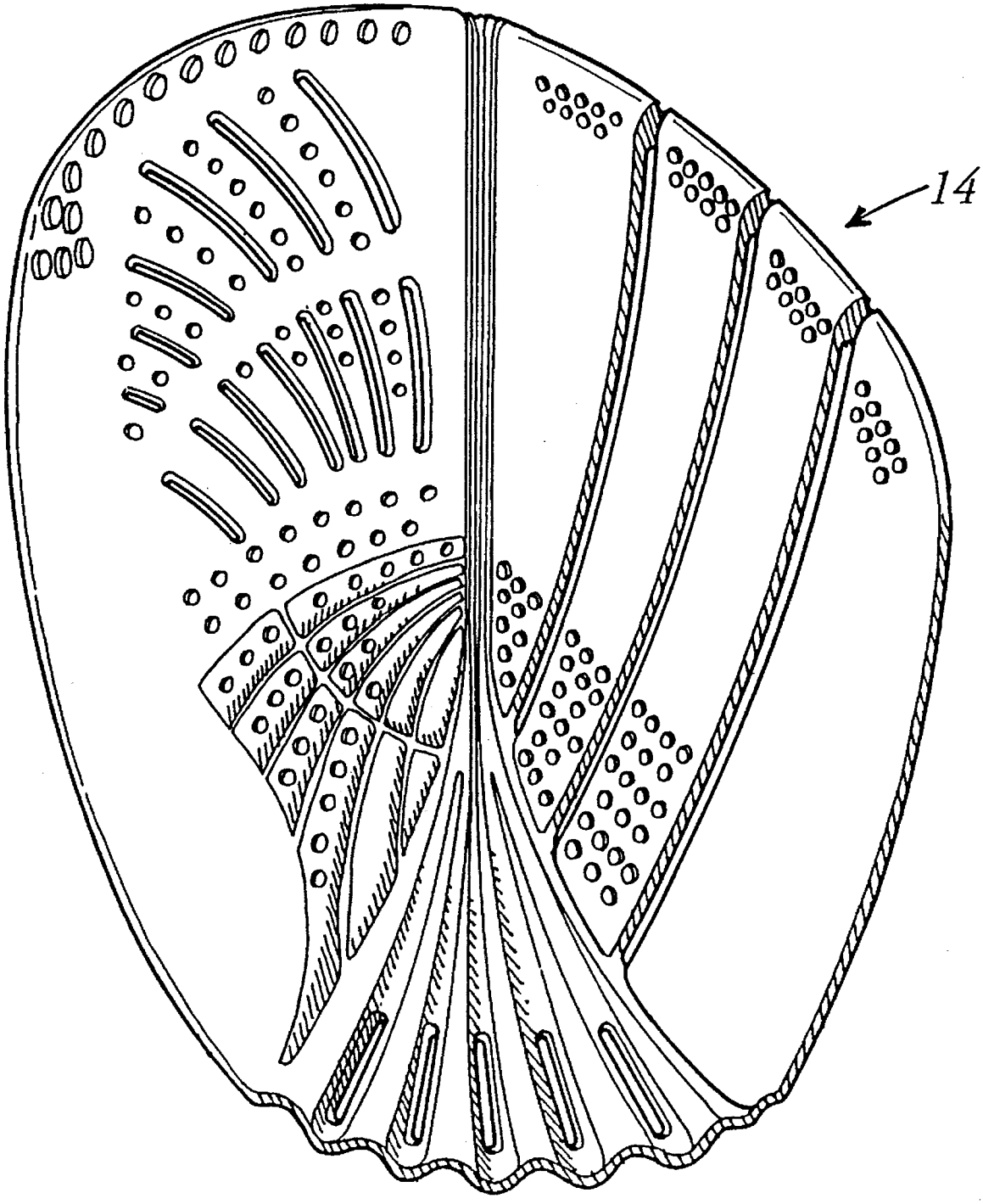
FIGS. 2A and 2B make up an exploded frontal view in perspective illustrating a two part assembly of the present invention.
Figure 2B:
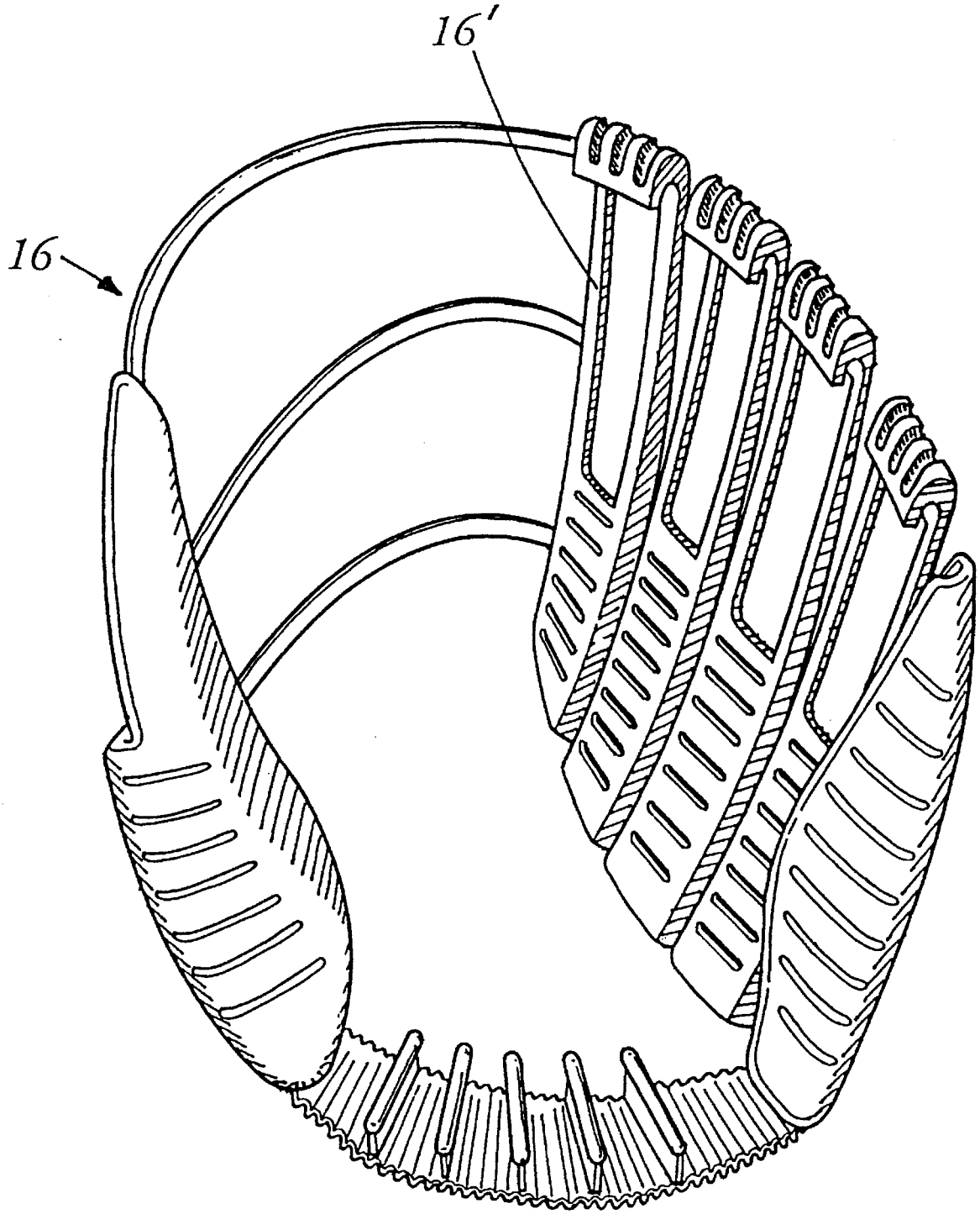

As shown in the exploded view of FIG. 2, the shell 10 is preferably a two part assembly, one part of which is a flexible, sheet-like, preferably elastomeric skin 14. A skeleton 16, which is the second part of the shell 10, is comprised of frame members 16' which make up a structural framework that is stiffer than the skin 14. The skin 14 is attached to, and extends between and within, the framework of the skeleton 16, maintains the shape of the skeleton 16, and fills in gaps between skeletal members.

The skin 14 and skeleton 16 may be molded separately and then attached after they have solidified. It is equally possible to mold the skeleton 16, letting it solidify, then mold it to the skin 14.

The preferred materials used to form the shell 10 are thermoplastic elastomers and thermoplastic urethanes. Preferably, a shell 10 can be manufactured using, for example, a polyether amide sold under the trade name Pebax or a urethane sold under the trade name Pellethane. Ball gloves can also be made of PVC and of styrene blends, but will have poorer performance characteristics. The materials used perform well due to their tear resistance, tensile strength, flexural modulus and flexibility. The present invention is not limited to use of these materials, but these materials are used due to their properties. Other materials may be substituted for these materials if they have similar or superior strength, tear resistance, flexural modulus and flexibility properties.

Experiment has determined that these preferred materials advantageously exhibit these characteristics when formulated to have a flexural modulus and a durometer hardness within measured ranges. The preferred range of durometer hardness values for the skin 14 is between 50 and 70 on the shore A scale. The durometer hardness of the skeleton 16 preferably ranges between 65 and 90 on the shore A scale. The durometer hardness tests performed conformed to ASTM test methods for test D-2240. The preferred range of flexural modulus for the skin 14 is between 1500 psi and 3000 psi. For the skeleton 16 the flexural modulus range is between 2200 psi and 4000 psi. The flexural modulus tests performed conformed to ASTM test methods D-790.

The concave, ball-receiving surface of the shell 10 preferably has a plurality of raised bumps 18 formed around its perimeter and on a palm region of both the skin 14 and the skeleton 16. The primary purpose of the bumps 18 is to increase the grip on a ball by providing a mechanical interengagement between the bumps 18 on the shell 10, and seams and other surface contours on a ball. The bumps 18 improve the grip provided by friction alone and reduce the possibility that a ball in the shell 10 will slip out. The bumps 18 also concentrate a contacting ball's impact energy on the small areas and change the sound the ball makes when impacting the plastic shell 10, to give a typical ball glove sound and feel. The bumps 18 may be strategically shaped to promote or negligibly hinder movement of the ball deeper into the shell 10, while preventing the ball from being displaced out of the shell 10. For example, the bumps 18 may be ramp shaped or angled to give a "barb" effect allowing motion in one direction, but resisting it in the opposite direction. Additionally, the bumps 18 aid in maintaining the appearance of the shell 10 by sustaining most of the wear of the shell.

Figure 3:
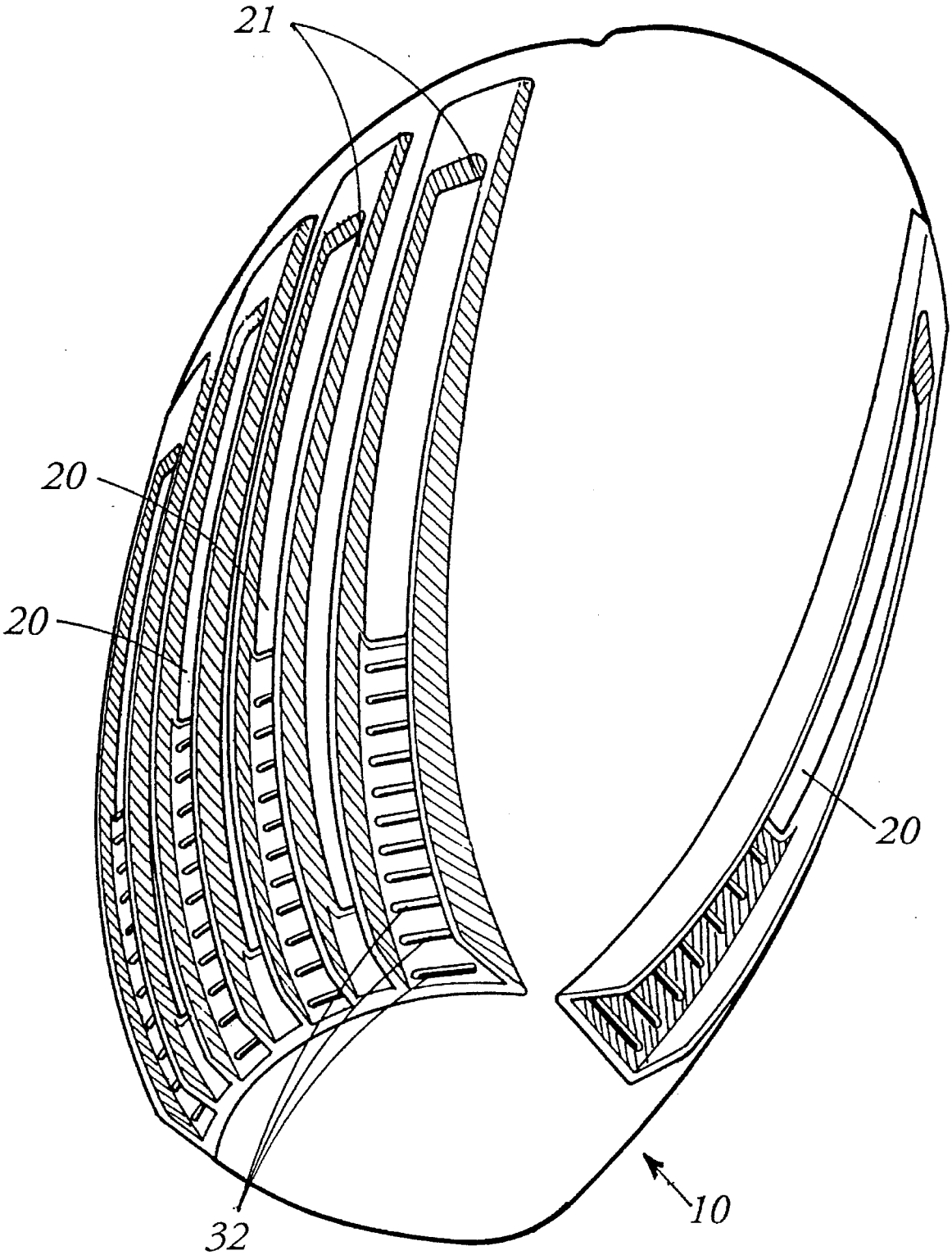
FIG. 3 is a rear view in perspective illustrating the preferred shell.

The convex rear surface of the shell 10, shown in FIG. 3, has channels 20 formed along finger regions, into which a person's fingers are placed. The sidewalls of the channels 20 form structural ribs 21 which help to reduce lateral motion of the fingers with respect to the shell 10, and increase the stiffness of the shell 10 along the channels 20. The increased stiffness helps to better transmit the force applied along the finger regions of the shell 10. The structural ribs 21 are formed on each side of the finger channels 20, extending along each finger channel 20 to near the edge of the shell 10. These ribs 21 are part of the skeleton 16 in the preferred embodiment. The ribs 21 provide selective rigidity to the shell 10, and function as a mechanical extension of the user's fingers, transmitting the force of the fingers to the shell 10, extending beyond the finger regions to near the edge of the shell 10. The ribs 21 permit control of the movement of the portion of the shell 10, which extends beyond the finger regions.

As shown in FIG. 1, the preferred shell 10 also has long, narrow slots 22 formed both between and generally parallel to the finger regions, as well as through a web region. The slots 22 form boundaries between the finger regions and reduce the transmission of motion of one region of the shell 10 to the adjacent region or regions. This property is very important in the finger regions where one finger region of the shell 10 can move somewhat independently of the surrounding finger regions. This permits more natural control of the shell 10 and therefore enhances the user's ability to grasp a ball with the shell 10 by surrounding it, rather than clamping or pinching a ball between the two flat sides of a conventional ball glove. The preferred slots 22 extend downwardly from near the top edge of the shell 10, shown in FIG. 1, terminating between the finger regions near where the crotches between a person's fingers are positioned when the ball glove is being used.

In addition to the slots 22, there are narrow, localized, generally linear bands called lines of preferred flexure 23 formed on the shell 10, along which the shell 10 is designed to flex. Each line of preferred flexure 23 preferably has a lower thickness than the immediately surrounding region of the shell 10, although other structures can produce the same results. The lines of preferred flexure 23 are formed at the ends of the slots 22 between the finger regions of the shell 10, along a path extending from between a thumb and palm region to the web region in the preferred embodiment and in various other places on the shell 10. The material at the lines of preferred flexure 23 flexes more easily than the surrounding material due to the reduced thickness. The lines of preferred flexure 23 are formed in and along specific regions of the shell 10 to promote a natural, hand-grasping closure of the shell 10 as well as promoting independent motion of each finger. FIG. 1A shows a line of preferred flexure 23 enlarged and viewed in section to illustrate the "necking" or reduction in thickness of the material along the line of preferred flexure 23.

Figure 8:
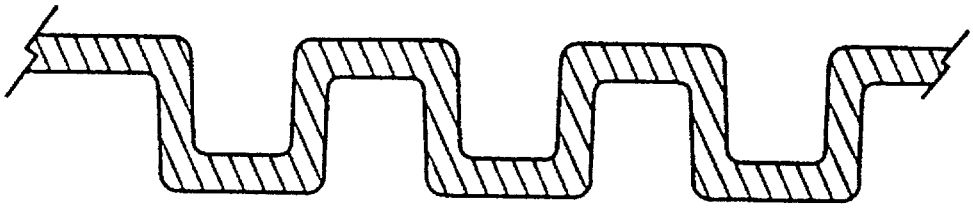
FIG. 8 is a view in section illustrating an alternative structure for forming lines of preferred flexure.
Figure 9:
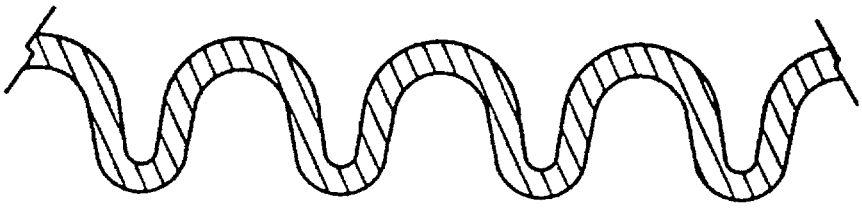
FIG. 9 is a view in section illustrating another alternative structure for forming lines of preferred flexure.

Regions of preferred flexure which will function similarly to the preferred "necked" structure forming the lines of preferred flexure 23 are illustrated in section in FIGS. 8 and 9. These include structures maintaining a constant thickness through their region.

FIG. 8 shows a "corrugated" structure retaining the same thickness as the surrounding structure. This embodiment localizes the flexure in the corrugated region, rather than the surrounding material, just as the preferred embodiment.

FIG. 9 illustrates a "scalloped" structure which functions similarly to the embodiment of FIG. 8 and demonstrates a second alternative to the line of preferred flexure 23.

The embodiments illustrated in FIGS. 8 and 9 show alternative structures for forming lines of preferred flexure and illustrate that the line of preferred flexure can be created without variations in thickness of the structure.

Referring again to FIG. 1, there are regions of the shell between the lines of preferred flexure 23, which are thicker than the lines of preferred flexure 23. These "padding" regions distribute the impact of a ball over a greater surface area than a thinner region would, thereby reducing the impact felt by the user.

The skeleton 16 also has a padding structure forming a "U" shaped region along the sides and lower perimeter of the shell 10. A thumb padding region 25, a palm padding region 27 including crests 24, and a heel padding region 29 form the padding structure of the skeleton 16. These give more rigidity to the sides of the shell 10 to enhance closure of the shell with the thumb and little finger of the user. The padding regions 25, 27 and 29 also deflect an incoming ball into the glove due to the angle they form with an impinging ball's trajectory when the shell 10 is held in its opened position. The padding regions 25, 27 and 29 also distribute the impact of an incoming ball over a large area to reduce the impact felt by the user.

Figure 4:
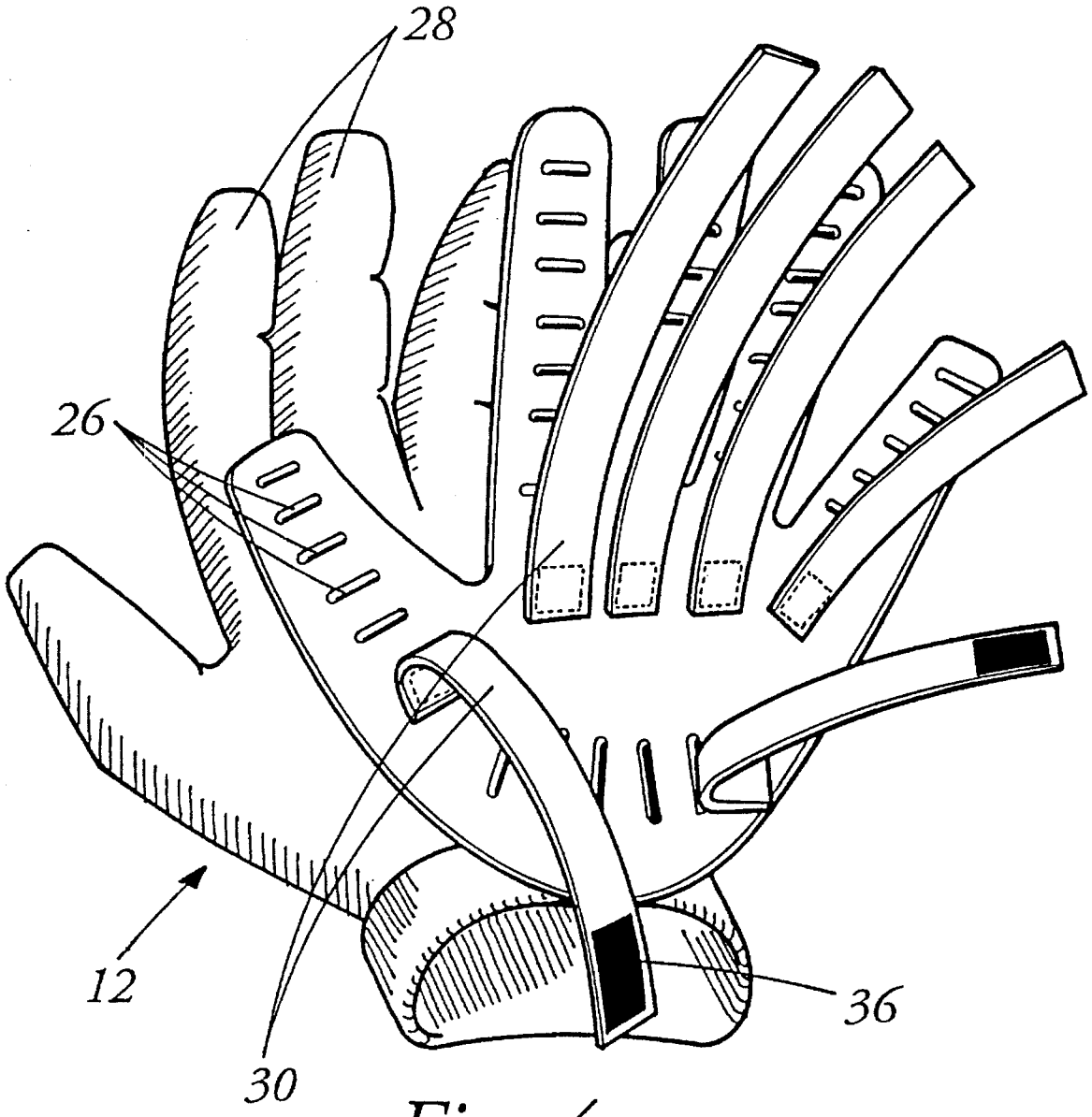
FIG. 4 is a frontal exploded view in perspective illustrating the preferred handpiece and showing a palm piece peeled away from the handpiece to show detail.

The preferred handpiece 12, shown in FIG. 4, is a tight fitting leather, or suitable fabric, glove that is removably fastened to the rear surface of the preferred shell 10, as shown in FIG. 1. In FIG. 4, five elongated regions of evenly spaced slots 26 are formed on and aligned parallel to each of five fingers 28 and a sixth elongated region of evenly spaced slots 26 is formed across a palm region of the handpiece 12. Corresponding strips 30, such as leather or nylon straps, are attached to an end of each elongated region of slots 26. An element 36 of a "hooks and loops" fastening means is attached to the end of each of the strips 30 and the backs of each finger 28. One type of "hooks and loops" material is sold under the trademark "VELCRO".

Because a lightweight material can be used for the handpiece 12, it can conveniently be provided with ventilation passages formed through the rear (not visible in FIG. 4) to allow cooling air to pass through. The ventilation passages can be holes intentionally formed, as in the leather by a leather punch. The passages can also be gaps existing between the fibers of coarsely woven fabric that is used to form the rear of the handpiece 12.

The shell 10, illustrated in FIG. 3, preferably has elongated regions of evenly spaced slots 32 formed in each of five finger channels 20 and across a palm region, the slots 32 corresponding to the slots 26 in the handpiece 12. The surfaces of the handpiece 12 and the shell 10 are placed against each other, aligning the slots 26 and 32, and the strips 30 are woven alternately through the slots 26 formed in the handpiece 12 and the slots 32 formed in the finger channels 20. The hooks and loops elements 36 are pressed together after the strips 30 are woven through the corresponding slots 26 and 32, attaching each strip 30 to the back of each finger 28 and keeping it from being pulled back through the slots 26 and 32.

The above described method of attaching the handpiece 12 to the shell 10 allows variability in the positioning of the user's hand with respect to the shell 10. Each slot 26 in the handpiece may be aligned with any of the slots 32 in the shell 10, so that the position of the handpiece 12 may be varied longitudinally to suit the preference of the user. Additionally, the preferred attachment provides the benefit of attaching each finger 28 of the handpiece 12 separately to the shell 10, which provides maximum control and flexibility of the shell by the hand of the user, while allowing maximum independence of each individual finger of the user. By attaching the palm of the handpiece 12 to the shell 10 separately, even more variability is allowed. Since permitting the motion of each part of the user's hand to be independently transmitted to the shell 10 is of primary importance, the separate attachment of each finger to the shell 10 allows maximum fingertip control without binding each finger to its neighboring finger.

Figure 5:
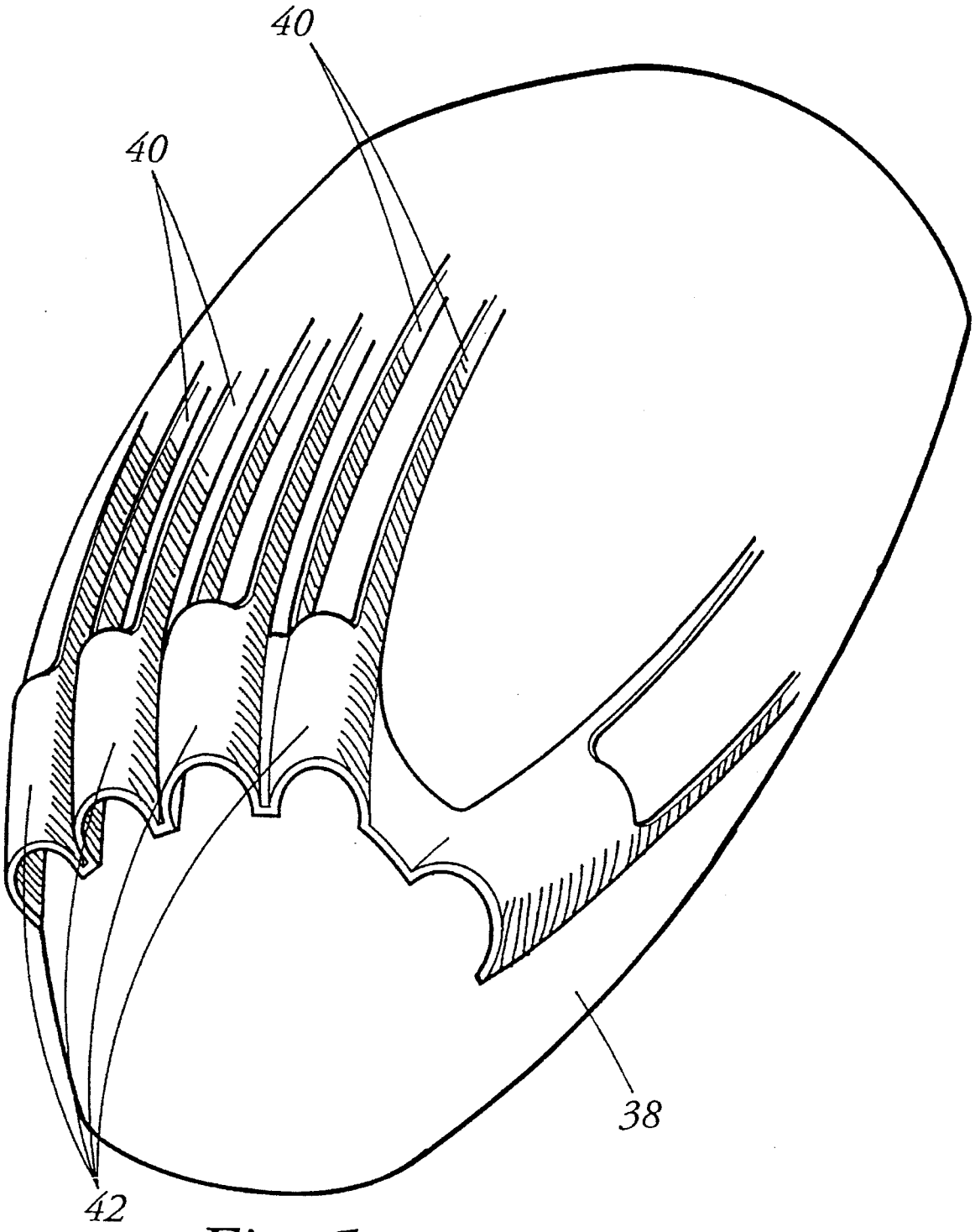
FIG. 5 is a rear view in perspective illustrating an alternative shell.

An alternative to the preferred shell 10 is a one piece shell 38, shown in FIG. 5, having the same general shape as the preferred shell 10, but made of only one kind of plastic, giving the shell 38 a homogeneous hardness. This alternative shell 38 has ribs 40 formed on either side of channels formed along finger regions, as in the preferred embodiment. There are also slots between each finger region and lines of preferred flexure, as in the preferred embodiment, but which are not visible in FIG. 5. The handpiece of the shell 38 comprises five loops 42, through which a user's fingers are inserted. The loops 42 are equivalent in function to a tight fitting glove attached to the back of a shell which is the preferred embodiment. The loops 42 are molded extensions of the shell 38, formed during the manufacture of the shell 38.

A handpiece, such as a glove, can be removably attached to nearly any shell giving wide variability in the possible combinations in the size and style of handpieces and attached shells. The same attachment means used in the preferred embodiment, or more simple structures, may be used on any of these variations. Examples of these alternative simple structures include "hooks and loops" material bonded to the mating surfaces of a glove and a shell, or straps which extend from a shell around the fingers of a handpiece and attach back to the shell. Straps 50, shown in FIG. 6, extend from a handpiece 47, through a shell, and attach back to the handpiece 47. With the two piece shell 10, a flexible flap 44, shown attached to a handpiece 46 in FIG. 7, may be placed between the skin 14 and the skeleton 16 of FIG. 2. The flap 44 is sandwiched between the skin t4 and the skeleton 16 in the palm region of the shell 10, fastening the palm of the handpiece 46 to the shell 10. Hooks and loops material 45 is attached to the flap 44 and the palm region of the shell 10, and they are engaged to hold the flap 44 in place once the shell 10 is assembled.

The preferred shell 10 and handpiece 12, illustrated in FIG. 1, are attached, as described above, by strips 30 woven through slots 26 and 32, as shown in FIGS. 3 and 4. The shell 10 and handpiece 12 could equivalently be assembled by adhering the handpiece 12 to the shell 10 with glue. The handpiece 12 could equivalently be attached to the shell 10 by attaching "hooks and loops" material to adjoining surfaces of the handpiece 12 and the rear surface of the shell 10 and compressing the two together.

Figure 6:
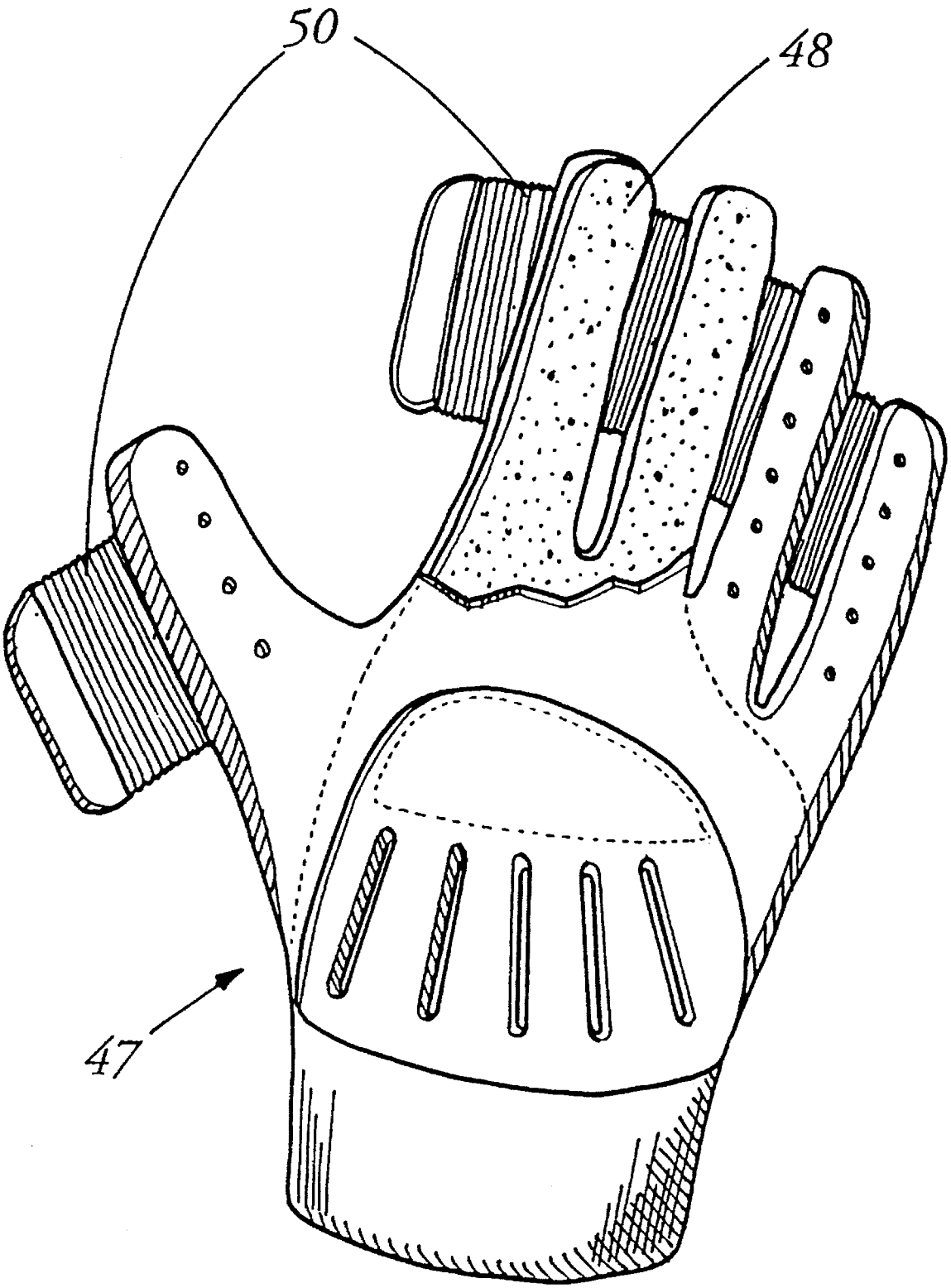
FIG. 6 is a frontal view in perspective illustrating an alternative handpiece.
Figure 7:
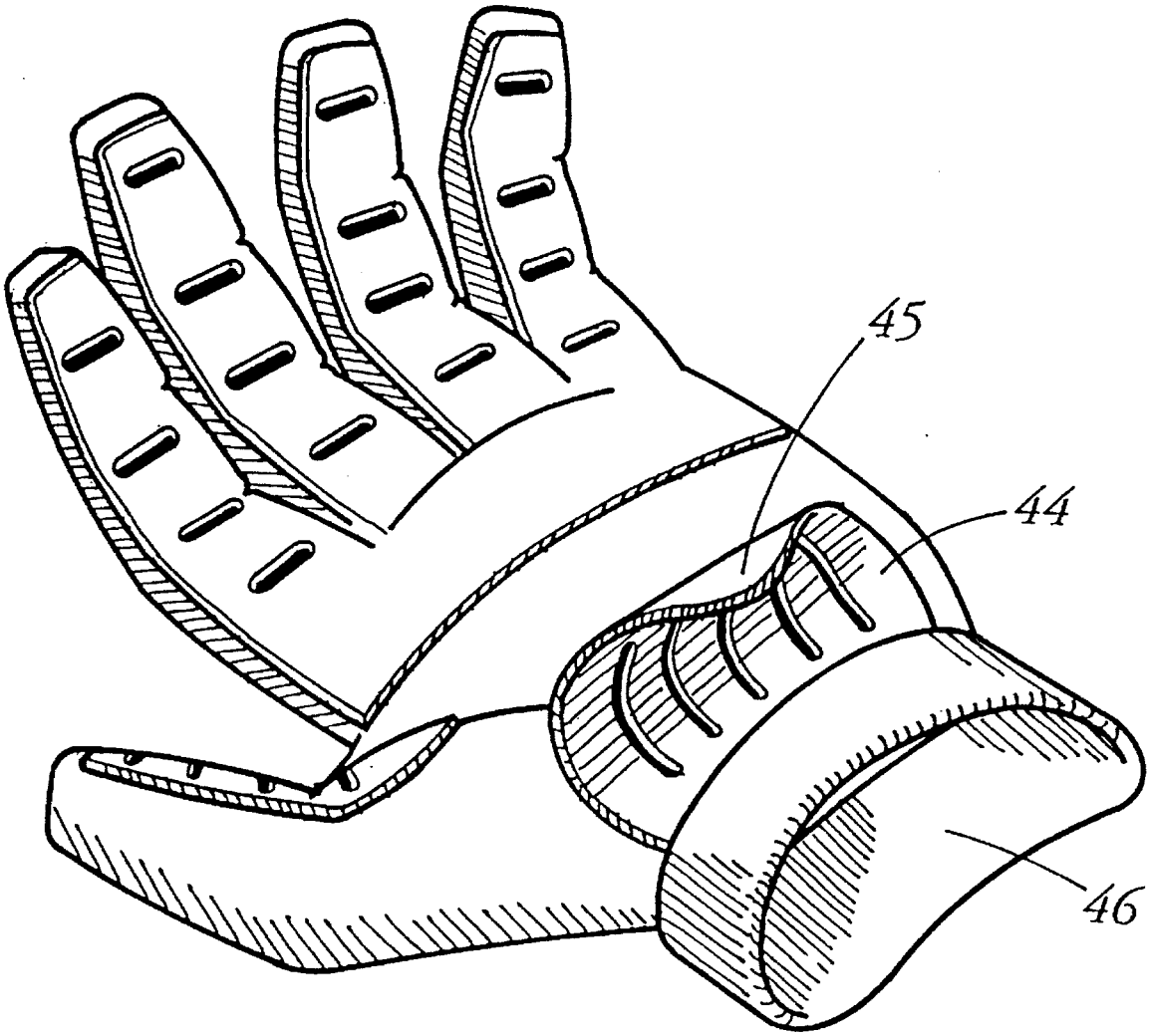
FIG. 7 is a view in perspective illustrating another alternative handpiece.

The handpiece 47, shown in FIG. 6, has padding 48 covering surfaces of the handpiece 47 that are between the user's hand and the skin surface where a ball which is caught may strike. This can be removably or permanently attached to the handpiece 47 to reduce, by spreading out over a large area, the impact of a ball on the user's hand. By making the padding 48 removable, the amount of padding can be varied to suit the user's preference. The padding 48 on the palm of the handpiece 47 may be neoprene foam, a jell-like material or a jell filled envelope which, upon impact, distributes the force and transforms the mechanical energy of the ball into heat energy by moving the soft padding, causing internal friction. The handpiece 47 not only can have different types of padding 48, but also may be used in conjunction with different shells to increase the variability of the ball glove.

The preferred embodiment of the present invention is a thermoplastic, elastomeric, injection molded ball glove. The properties of the glove ensure that it does not need to be "broken in". The ball glove is ready to use when it is fully assembled, and, as is a preferred characteristic of the selected plastic, the flexural and hardness characteristics of the glove will negligibly change over time. Additionally, the preferred plastic will be soft and pliant enough to conform to the motion of the user's hand.

The preferred method of manufacturing the present invention comprises injecting a liquid or semi-liquid thermoplastic polymer into a mold or number of molds having a cavity with the shape of the preferred shell or shell parts. The liquid plastic fills the mold, cools or cures and solidifies. The solidified plastic is then removed from the mold and a handpiece is attached after the shell and its parts are assembled, if necessary.

[Improved Embodiment]

FIGS. 10–20 illustrate an improved ball glove embodying the invention. The ball glove has a shell 100 which has a concave, frontal, ball-receiving surface 104 and an opposite, convex rear surface 106. The glove also has a glove-like handpiece 102, detachably mounted to the rear of the shell 100. The handpiece 102 is separately illustrated in FIGS. 16 and 17.

The adjectives "proximal" and "distal" will be used with the wrist of the wearer as a reference. The term "axial" will be used with reference to an extension of the axis of the wearer's arm. The term "lateral" refers to a direction transverse to the axial direction.

The shell has a proximal edge 108 located adjacent to a hand-receiving opening 110. Adjoining the proximal edge 108 are finger-receiving cavities 112, which are aligned generally in an axial direction. The preferred finger-receiving cavities 112 are formed as five pockets for receiving each of the five fingers of the wearer, including a thumb cavity 114 and a little finger cavity 116. Opposite the proximal edge 108 is a laterally extending, distal, peripheral edge 118. The frontal surface of the glove is formed with a palm region 122, a thumb region 124, a finger region 126, and a web region 128 extending between the thumb region 124 and the finger region 126.

A plurality of generally axially oriented ridges 130 are formed along and extend outwardly from the frontal surface 104. Preferably, the ridges 130 extend from near the proximal edge 108 to near the distal peripheral edge 118, so that the ridges extend entirely across the finger region 126, the palm region 122, and the thumb region 124 in smoothly flowing, continuous contours. There may, however, be some shorter ridges which do not extend the entire distance, such as abbreviated ridge 132. The ridges may, alternatively, be formed in aligned, discontinuous segments to obtain the same result. The ridges provide padding to distribute and attenuate impact energy and assist in channelling the ball toward the pocket located at the web regions 128 adjacent the palm region 122. They also orient the flex lines along the valleys between the ridges to enhance the desired flexibility between the thumb and remaining fingers. This enables the wearer to comfortably trap and grip the ball in the pocket.

Figure 10:
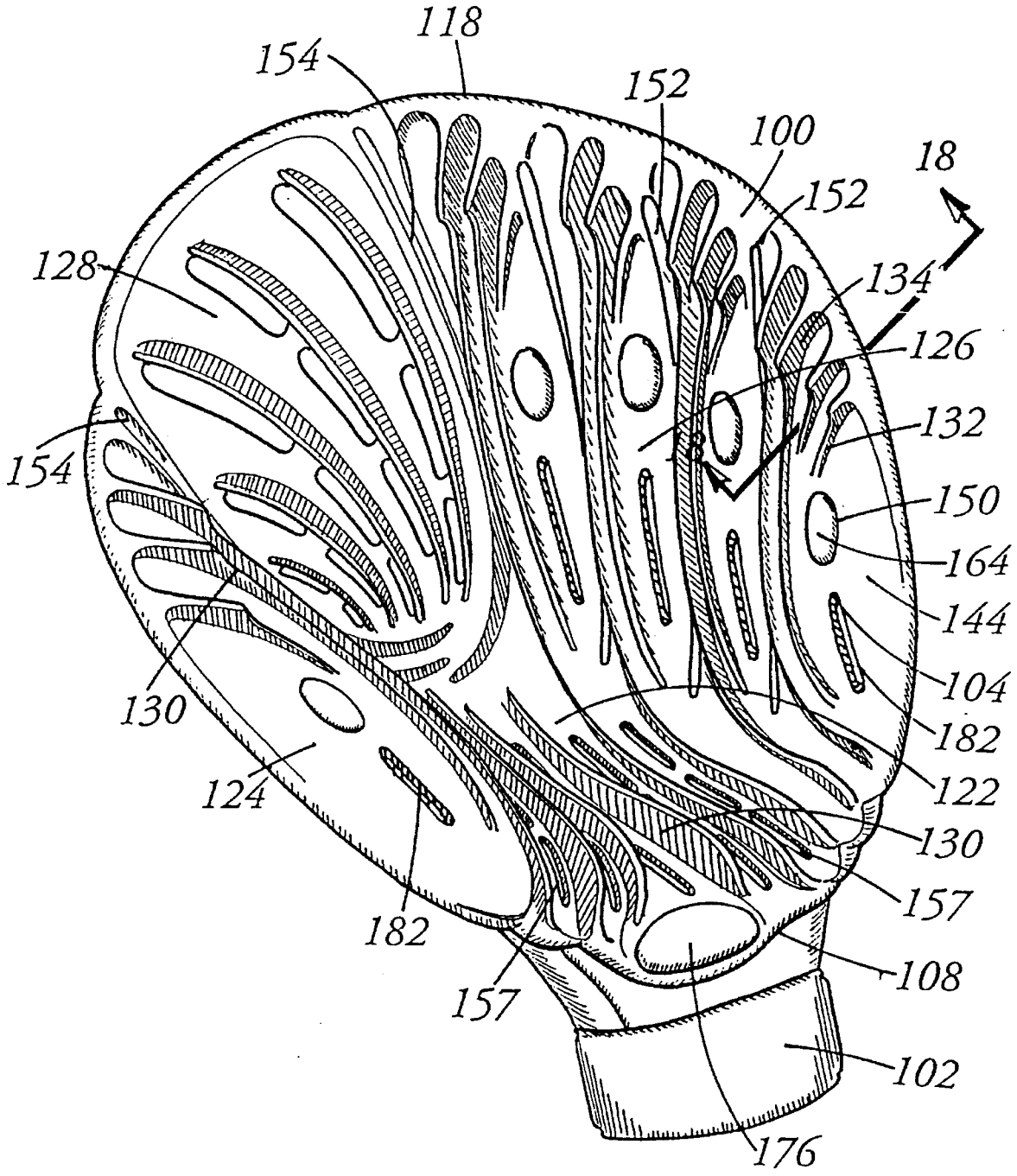
FIG. 10 is a view in perspective illustrating the frontal surface of the improved preferred embodiment of the invention.
Figure 11:
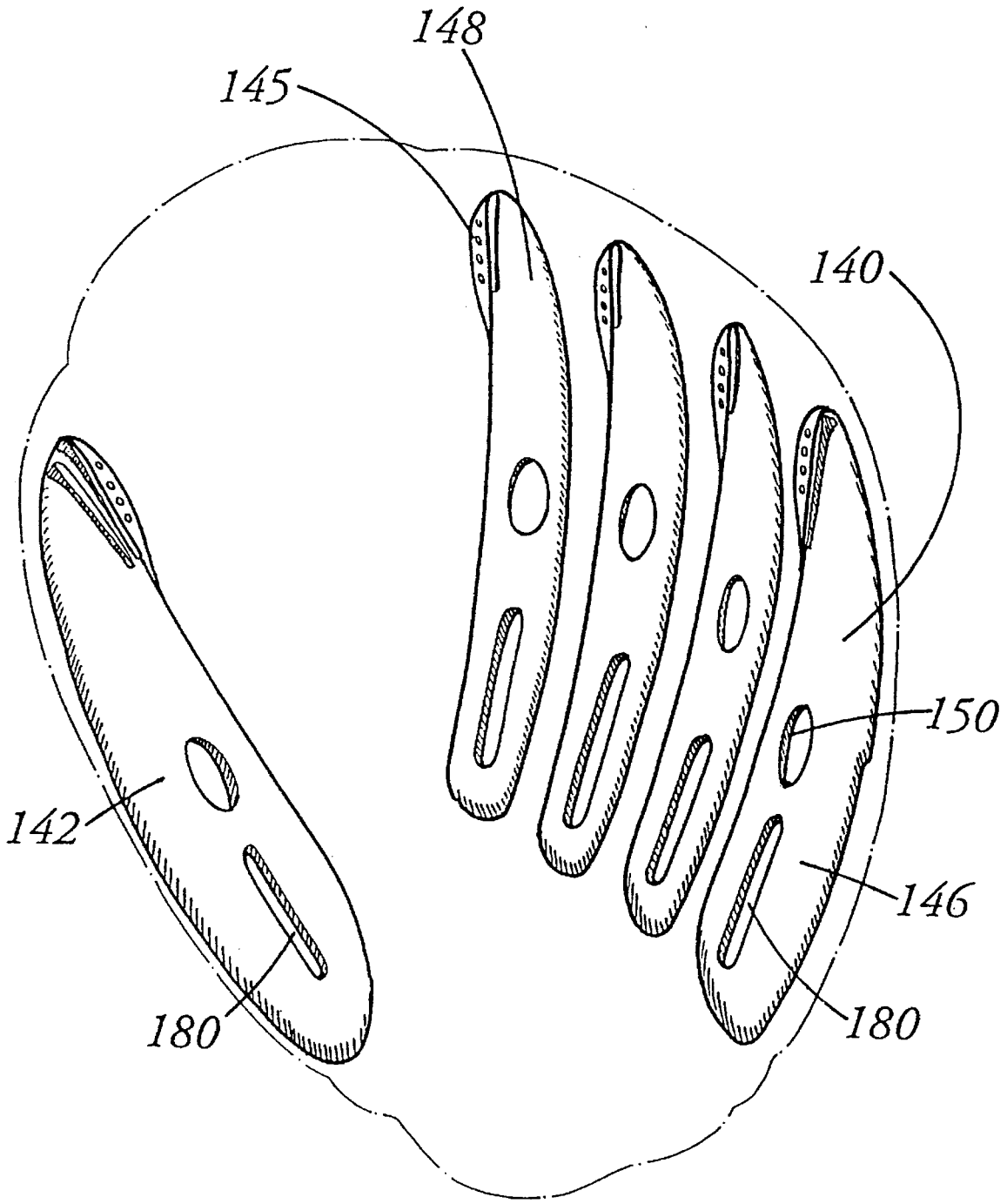
FIG. 11 is a view in perspective looking in the same direction as in FIG. 10 but illustrating the skin material removed, but outlined in phantom, to reveal the underlying ribs.
Figure 12:
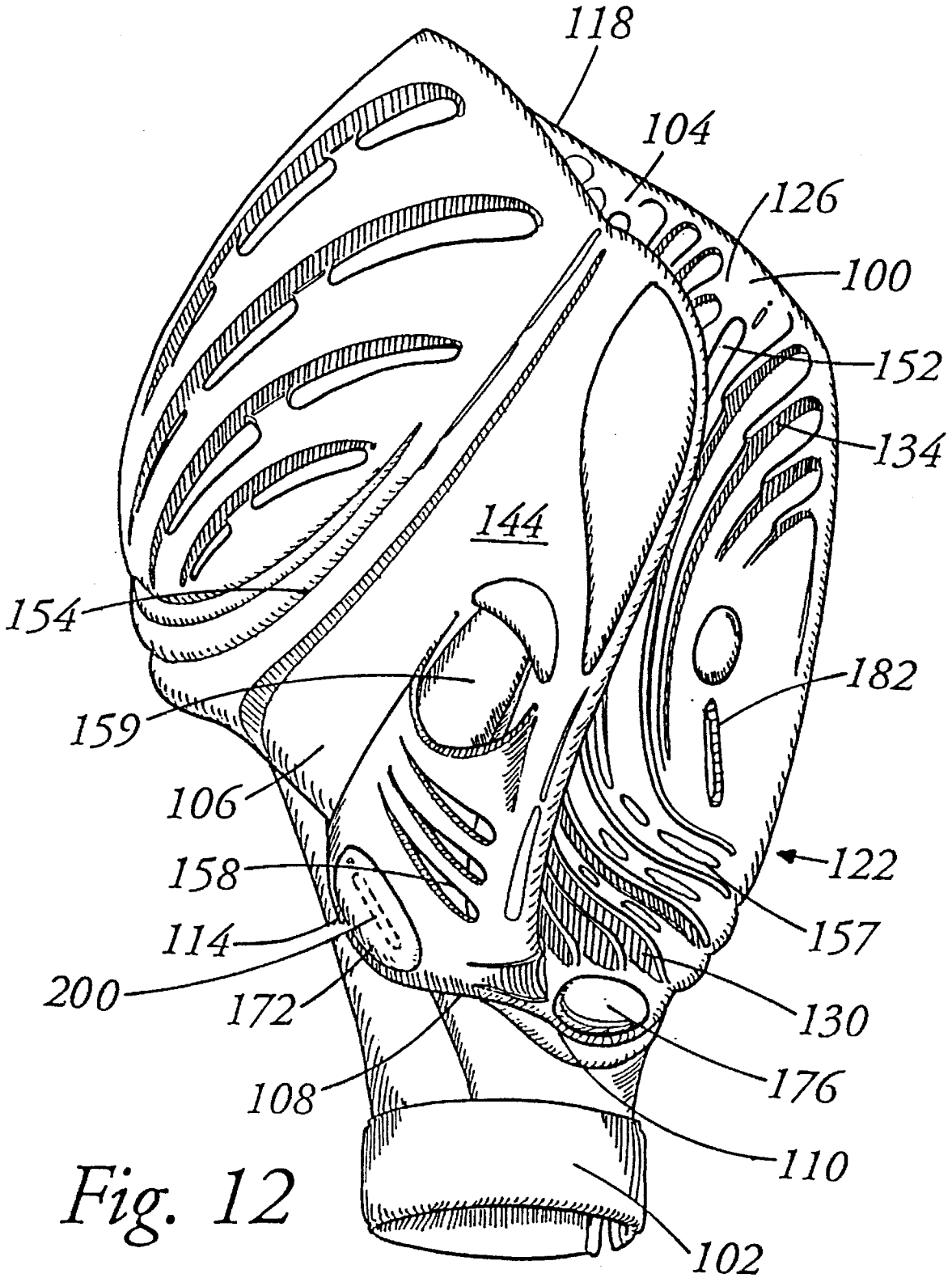
FIG. 12 is a view in perspective looking at the thumb and web side of the embodiment of FIG. 10.
Figure 13:
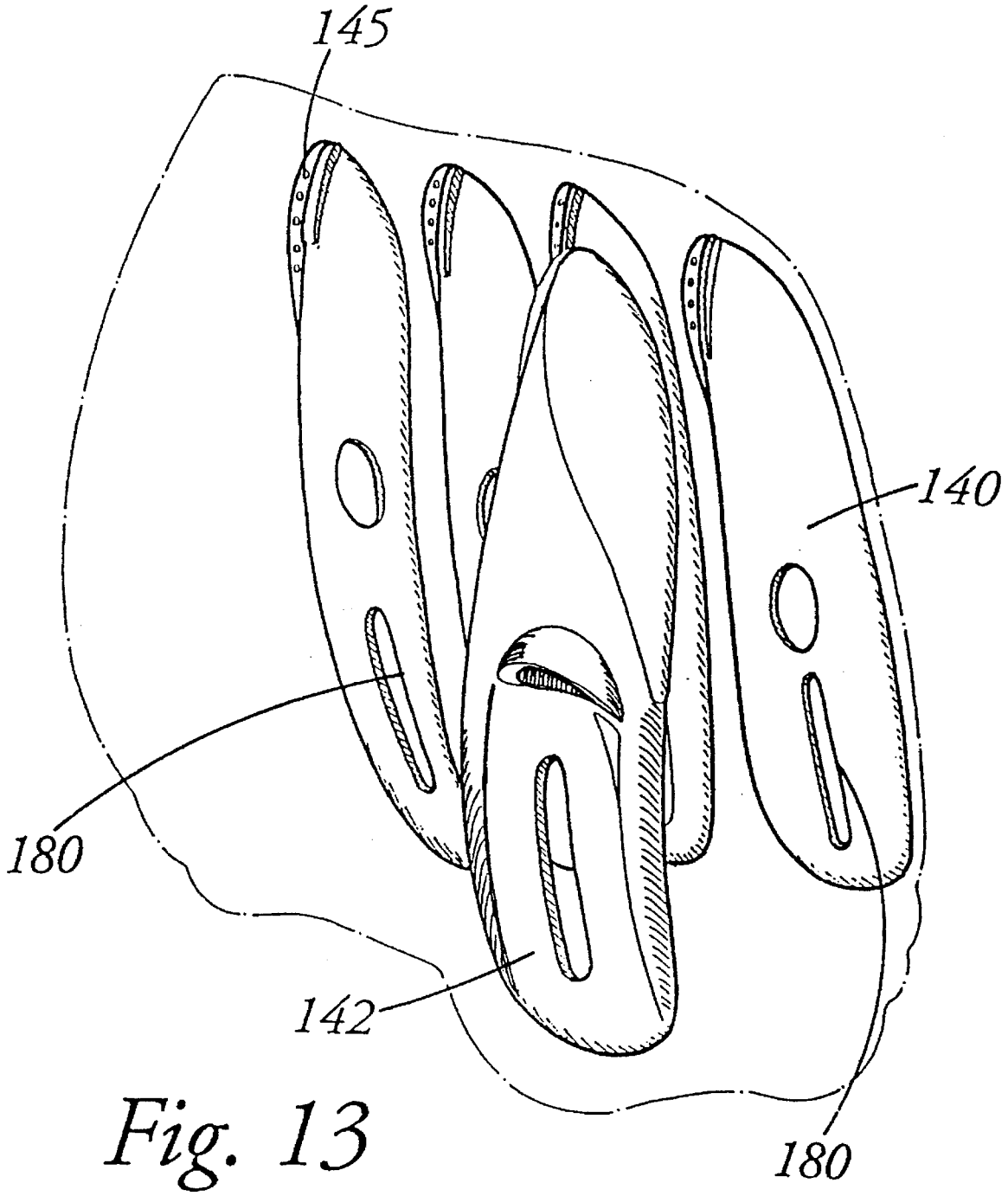
FIG. 13 is a view looking in the same direction as in FIG. 12 but illustrating the skin and handpiece removed, the skin being outlined in phantom, to reveal the underlying ribs.
Figure 14:
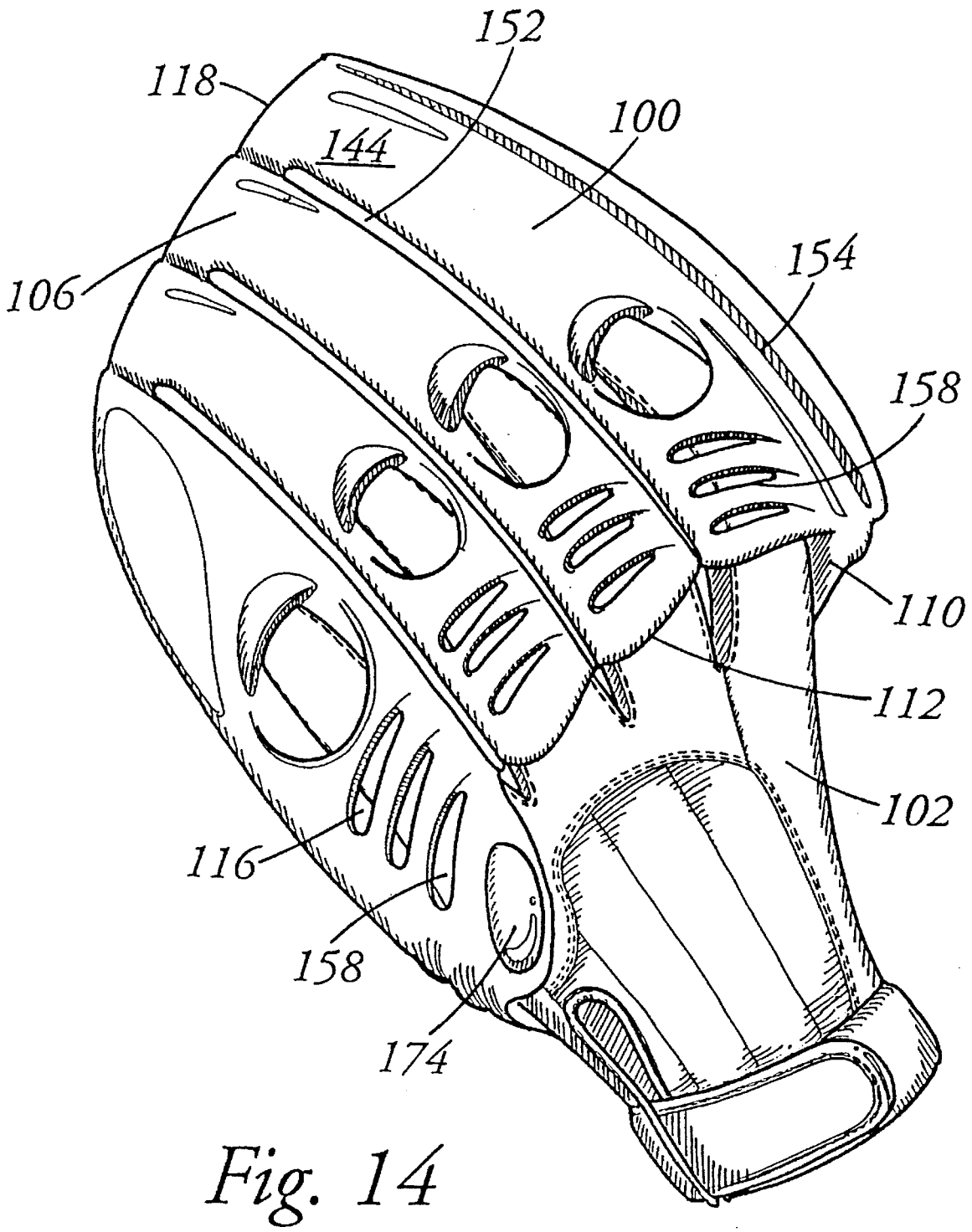
FIG. 14 is a view in perspective of the rear of the embodiment of FIG. 10.
Figure 15:
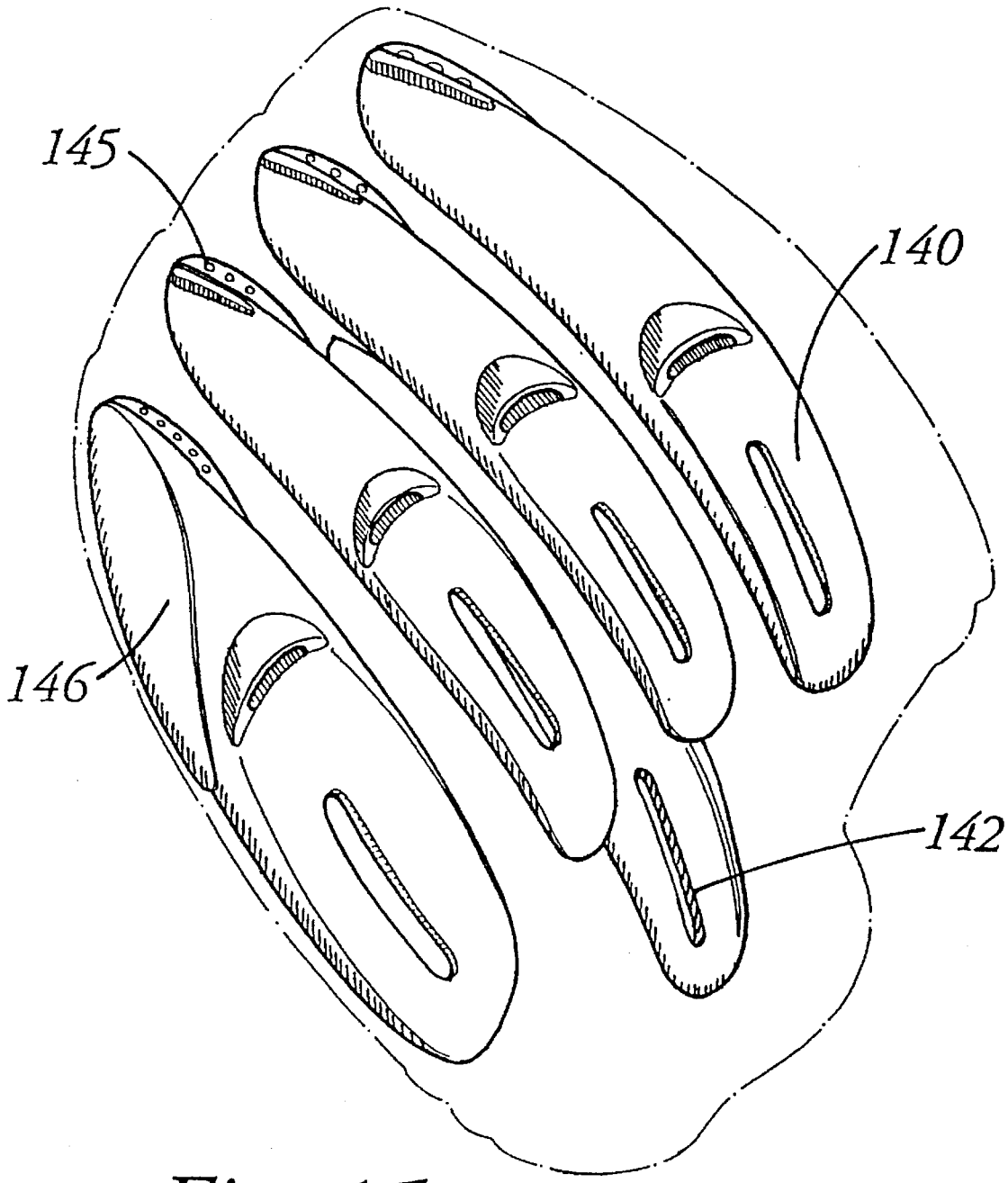
FIG. 15 is a view in perspective of the embodiment of FIG. 10 and looking in the same direction as in FIG. 14 but illustrating the skin and handpiece removed, the skin being outlined in phantom, to reveal the underlying ribs.
Figure 18:
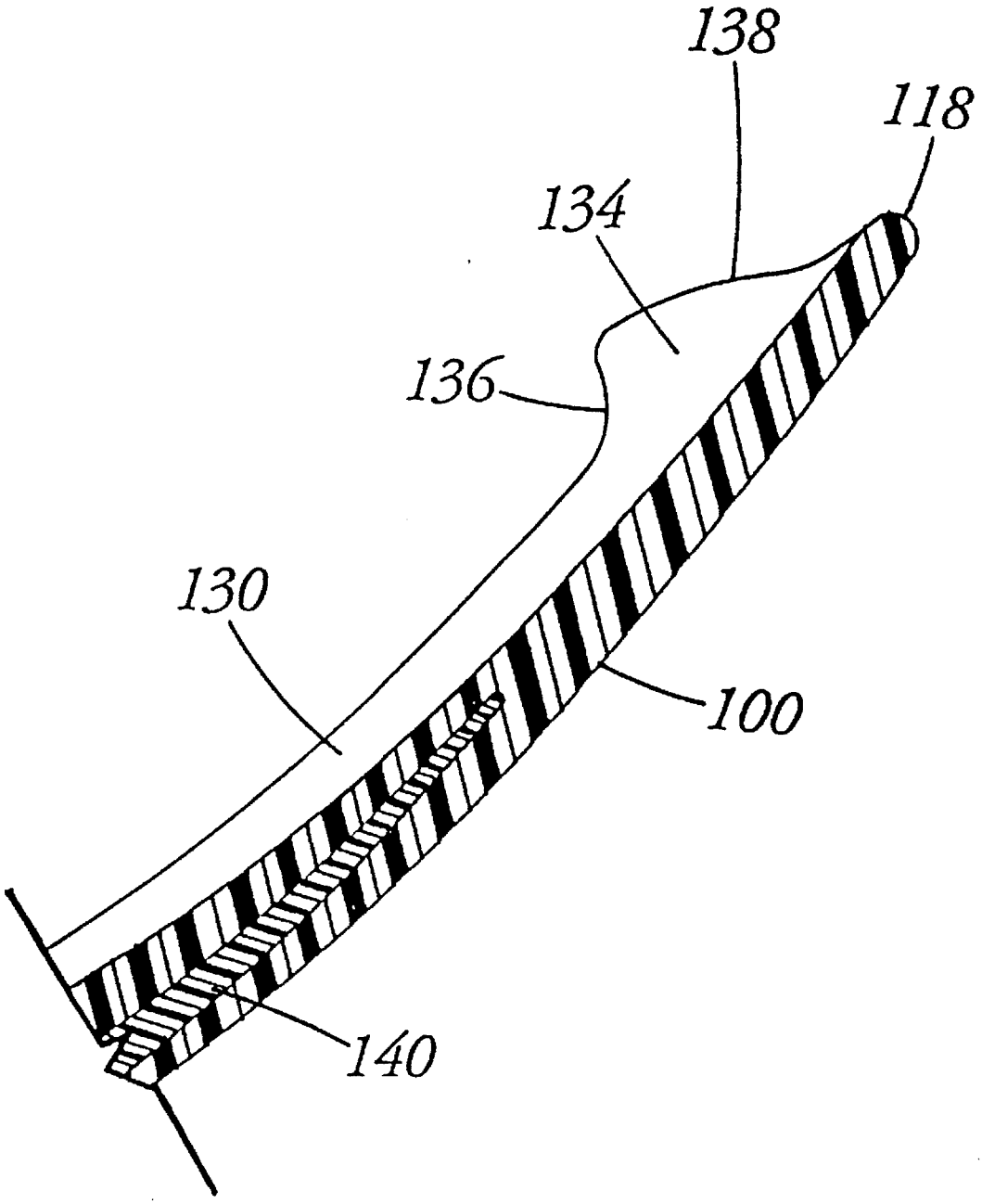
FIG. 18 is a view in section taken substantially along the line 18—18 of FIG. 10 showing a portion of the embodiment of FIG. 10 and illustrating in more detail a ridge and its protrusion constructed in accordance with the present invention.

Preferably, ball retaining protrusions, such as protrusion 134 visible in FIGS. 10 and 12, are formed at the distal ends of the ridges 130 and extend out further than the contiguous portions of the ridges. The detailed ridge structure is illustrated in more detail in FIG. 18. As shown in FIG. 18, the ridge 130 terminates with the ball retaining protrusion 134 near the distal, peripheral edge 118 of the glove. A shoulder 136 is formed at the proximal end of the protrusion 134 to assist in gripping a ball which has been received within the concave frontal surface 104 of the glove. The protrusion 134 tapers along its distal end 138 toward the peripheral edge 118 of the glove. This taper provides a smooth, continuous ramp to assist a ball rolling along the ground to make a smooth transition into the glove.

The shell 100 of the glove is reinforced by a plurality of generally axially oriented, elongated, flexible ribs in the thumb and finger regions of the glove. The ribs have a curved surface contour and curved peripheral edges. Preferably there is a rib for each of the wearer's four fingers and a rib 142 for the thumb. A rib is positioned frontally of each of the finger and thumb receiving cavities 112 and 114. The ribs 140 are held together by an elastomeric, resin polymer skin 144 which is conformingly attached to the ribs 140, and preferably is injection molded around the ribs. The skin 144 is molded to form the frontal surface 104, hand-receiving opening 110, and the finger-receiving cavities 112 of the glove.

It is preferred that the skin, the surface contour features of the glove, as well as slits, openings and ports yet to be described, all be formed as a unitary body of molded, elastomeric skin material. The material utilized to form the ribs and the material for forming the skin portion of the improved glove are the same as those described above for use in connection with other embodiments. The skin is more flexible than the ribs.

Table 1 illustrates the preferred combination durometer hardness characteristics for ribs and the skin of embodiments of the invention.

TABLE 1

| | SKIN DUROMETER HARDNESS | | | | |
|---|---|---|---|---|---|
| | 45–50A | 50–55A | 55–60A | 60–65A | 65–70A |
| RIB DUROMETER HARDNESS | | | | | |
| 65–80A | | | | | |
| 80–90A | | X | | X | |
| 90–95A(45–50D) | X | X | X | | |
| 95–100A(50–55D) | | X | | X | |
| 55–60D | | | | | |
| 60–65D | | X | | X | X |

A = Shore A Durometer Hardness Scale.
D = Shore D Durometer Hardness Scale.

The vertical columns show skin durometer hardness and the horizontal rows show rib durometer hardness. An X represents combinations which have been constructed and tested. Embodiments are preferably constructed with a skin having a durometer in the range 45–70 on the Shore A durometer hardness scale and ribs in the range of 65 on the Shore A durometer hardness scale to 65 on the Shore D durometer hardness scale. However, the most preferred embodiments have a skin hardness in the range 45–60 on the Shore A durometer hardness scale combined with ribs in the range 80–100 on the Shore A durometer hardness scale.

Although all of the reinforcing ribs 140 can be identical in a relatively crude embodiment of the invention, it is preferred that the sidemost ribs, the thumb rib 142 and little finger rib 146, be less flexible than the other ribs. Most preferably, the ribs become progressively more flexible in progression from the sidemost little finger rib 146 to the index finger rib 148, which is adjacent to the web region 128. The ribs are preferably formed with thinner regions at their opposite ends and thicker central portions in the region of a handpiece attachment port, such as port 150 formed in rib 146. The ribs provide additional axial rigidity for somewhat independent control by each finger and the thumb of the wearer and therefore reinforce each finger and the thumb. This assists in reaching the goal of lateral flexibility, but a degree of axial stiffness.

In order to improve the mechanical attachment of the skin 144 to the ribs 140, a plurality of holes 145 are formed transversely through the ribs 140 near their edge in high stress regions. Liquid skin material can flow into these holes during molding, to form a mechanical interlock between the skin 144 and ribs 140 instead of relying on a simple butt joint and adherence of the skin material to the rib material. The mechanical interlock further secures the skin 144 to the ribs 140. Alternative mechanical interlock structures can also be used., such as, for example, the formation of surface contours, such as sawtooth ridges on the rib surface or on a boss extending from the rib surface.

While the presence of the more flexible skin material interposed between the ribs allows some lateral flexibility for gripping a ball in the glove, the lateral flexibility is enhanced by providing a plurality of elongated slits 152 entirely through the skin and spaced between the ribs and the finger cavities which lie directly rearwardly of each rib. The presence of these slits 152 also assures that the glove will be regarded as a "glove" under the game rules and not as a "mitt" under the rules. However, the term "glove" in this patent is not used in the narrower meaning of the rules, "glove" including a mitt or mitten-like structure.

Although the ribs could be inserted into slit-like narrow pockets formed in the skin material, it is preferable that the ribs be positioned in an injection mold, constructed in accordance with conventional principles, so that the skin material can be injected to surround and encase the ribs. However, it is not necessary that the ribs be entirely encased and it is difficult to support the ribs in a mold in a manner that permits the injection molded skin material to flow entirely around all regions of the ribs. The ribs may lean against and be supported by the interior walls of the injection mold so that the finished product will have the ribs partially exposed where they contacted the mold walls. This has no undesirable functional consequences. The ribs could, alternatively, be bonded by means of a suitable adhesive to the rear surface of a molded skin.

Flex enhancing corrugations 154 forming a bellows-like structure are formed in a smoothly curved U-shape extending from the distal peripheral edge 118 along the interconnection region between the finger region 126 and web region 128 of the glove to the palm region 122 and then curving back along the thumb region 124 to return to the distal peripheral edge 118. Corrugations having two or three crests are preferred and may be in the form illustrated in FIG. 9.

A plurality of elongated ventilation passages 157 are preferably formed entirely through the skin 144 in the palm region 122 to form a grille. These elongated passages are conveniently positioned in the valleys between the ridges 130 and are therefore oriented generally in the axial direction. The presence of these ventilation passages also enhances the lateral flexibility of the palm region 122 of the glove.

Similarly, for embodiments in which the finger cavities 112 are enclosed pockets, a plurality of elongated, generally laterally oriented ventilation passages 158 may be formed through the rear surface 106 of the glove to open into each finger pocket.

Figure 16:
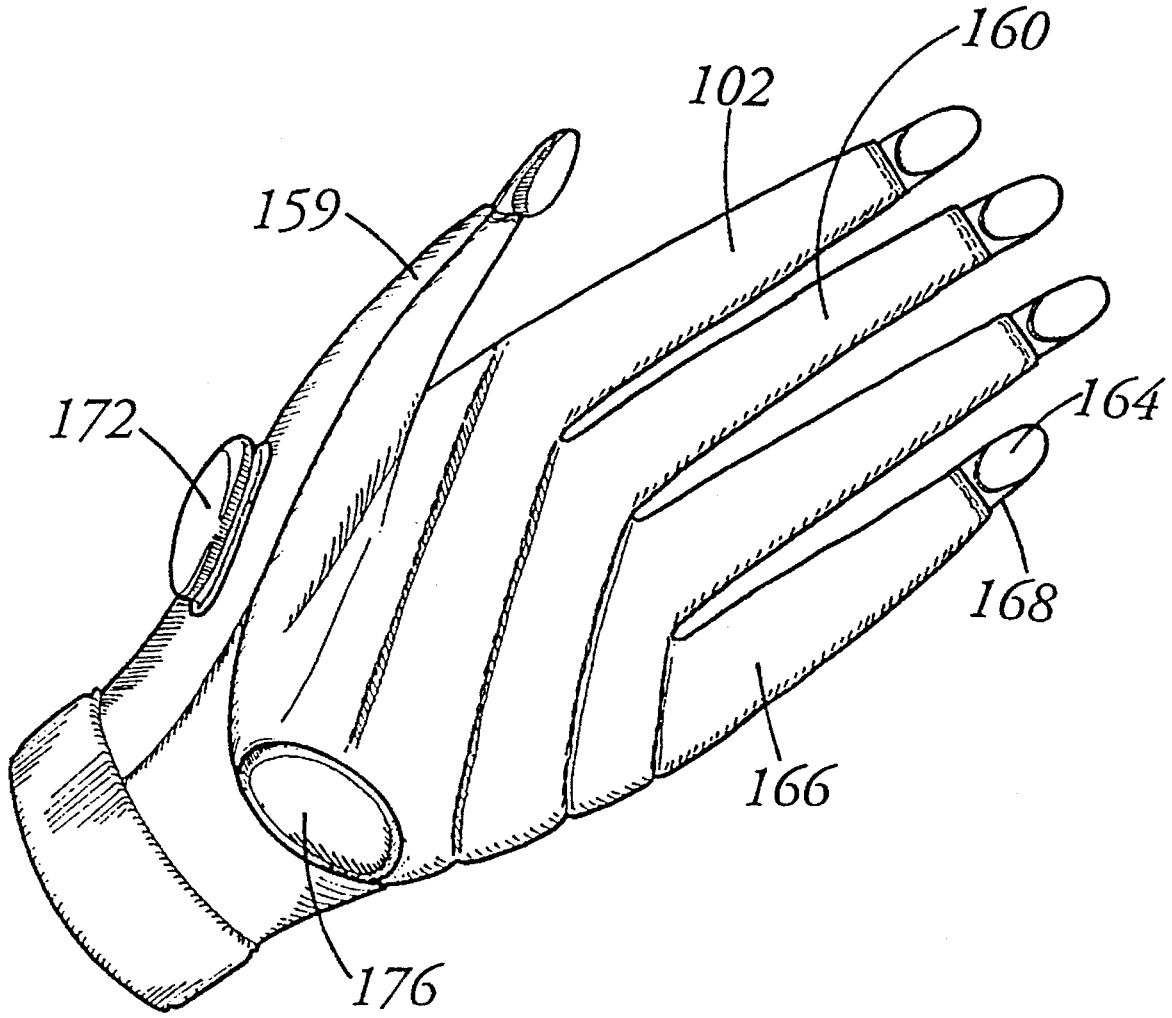
FIG. 16 is a view in perspective of the palm side of the handpiece portion of the embodiment illustrated in FIG. 10.
Figure 17:
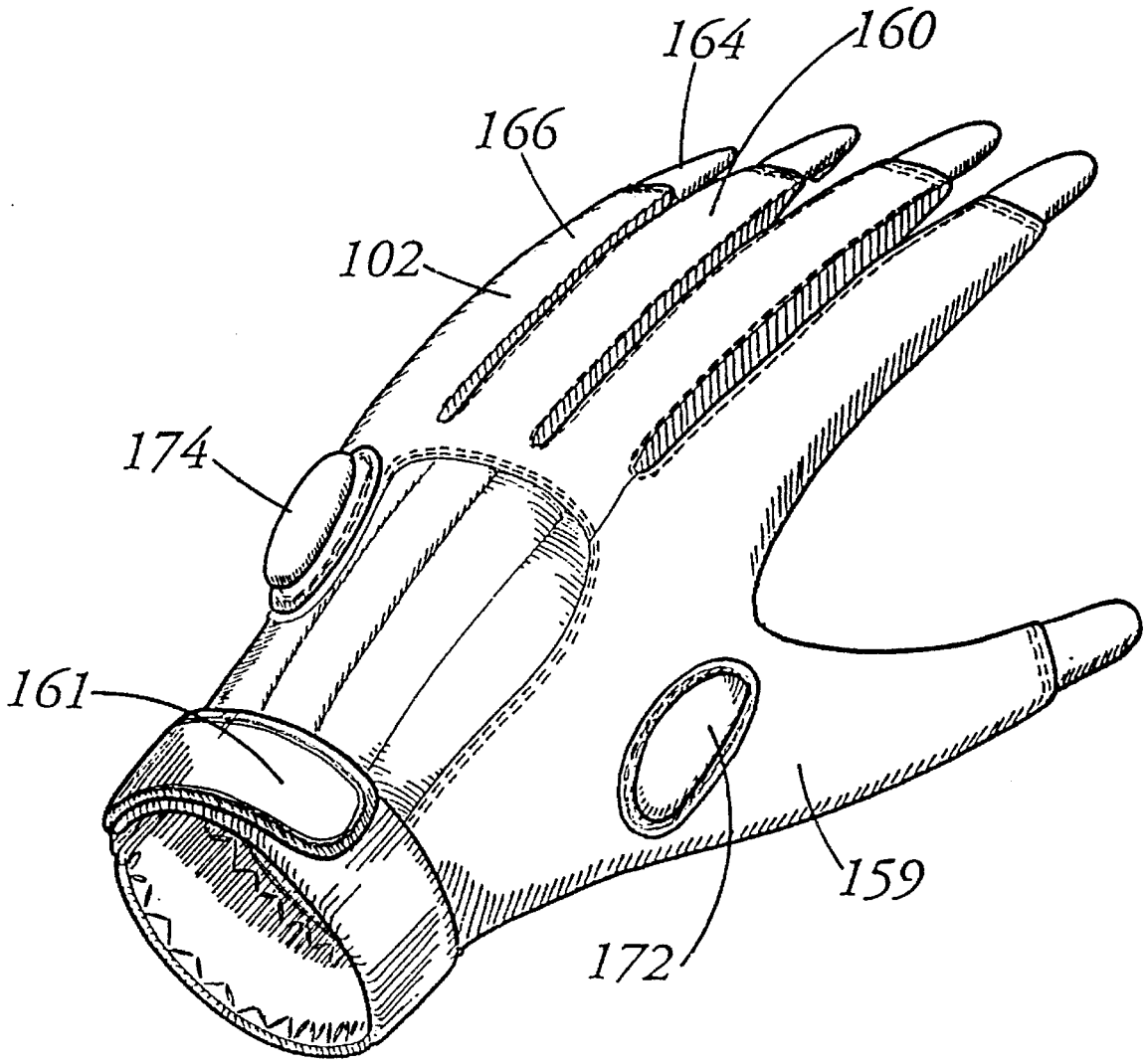
FIG. 17 is a view in perspective of the rear side of the hand piece of FIG. 16.
Figure 19:
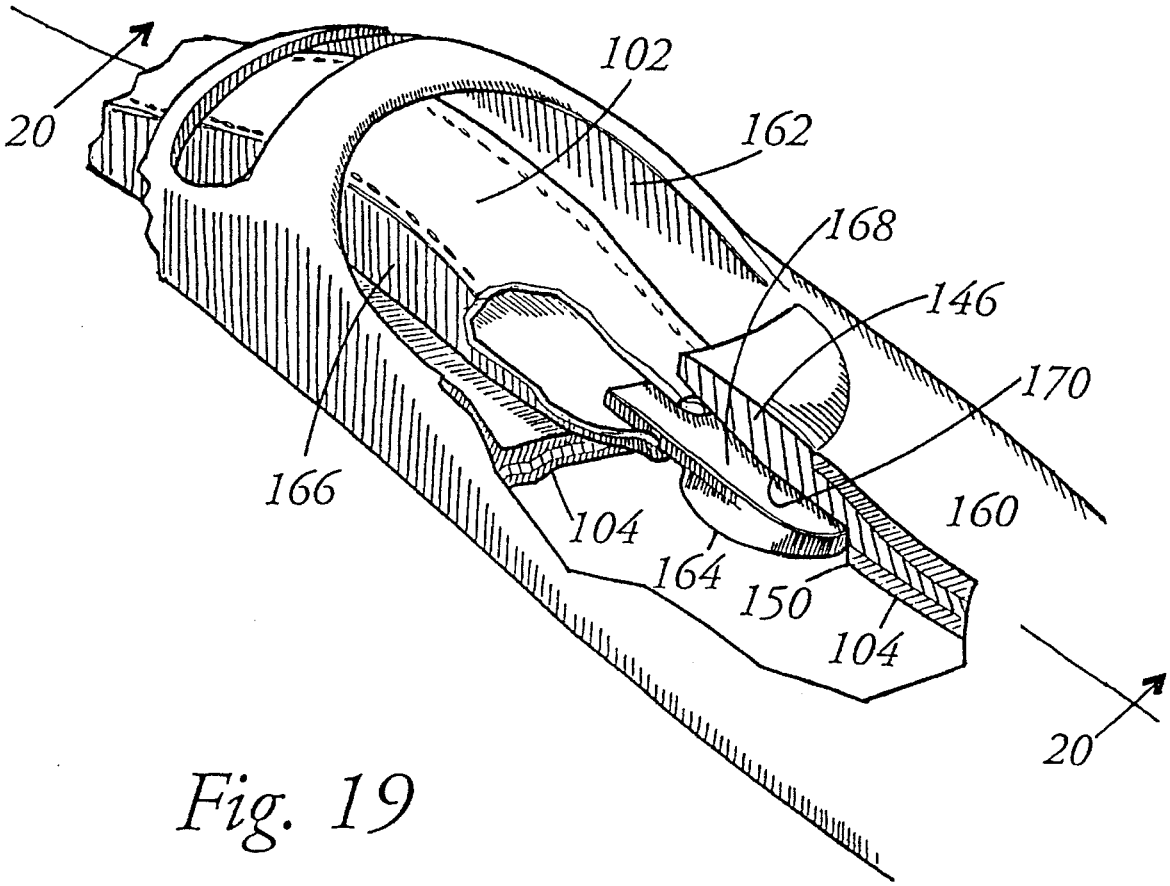
FIG. 19 is a partial view in perspective illustrating the tab and port structure of the present invention for attaching the hand piece to the assembled skin and ribs of the embodiment of FIG. 10.
Figure 20:
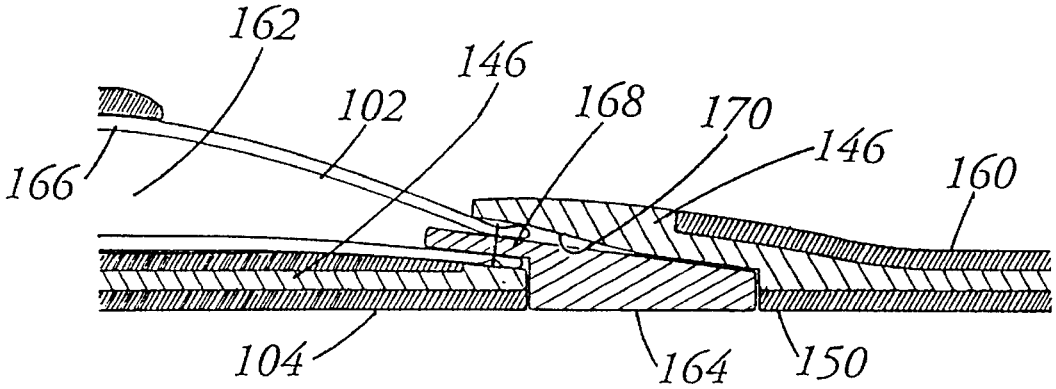
FIG. 20 is a partial view in section taken substantially along the line 20—20 of FIG. 19.

FIGS. 16 and 17 illustrate the preferred handpiece embodying the present invention, while FIGS. 18–20 illustrate details of the handpiece and its connection to the shell 100. The preferred handpiece is a glove-like handpiece 102 having a thumb 159 and fingers 160. It may be secured to the wrist by a conventional VELCRO hooks and loops type wrist strap 161. The handpiece 102 is detachably mounted at the hand-receiving opening 110 to the assembled skin and ribs which together form the shell 100. The finger portions of the handpiece 102 extend into the finger receiving cavities 112.

Although the handpiece can be detachably attached to the shell 100 by VELCRO hooks and loops, or other conventional connector structures such as those described above, a preferred attaching structure is illustrated in FIGS. 16, 17, 19 and 20. To accomplish the improved attachment structure, ports are formed through the skin 144 and ribs 140, preferably one port for each finger, such as the port 150 in the rib 146. Since the attachment structure is identical for each of the five fingers, it will be described further only in connection with the rib 146 positioned in the little finger position of the glove.

Each finger is held detachably in place by cooperating tabs fitted into mating ports. The port 150 communicates from the frontal surface 104 to the finger-receiving cavity 162. A button-like tab 164 is attached to the end of the little finger 166 of the handpiece 102, and similar button-like tabs are attached at the end of each finger of the handpiece 102. Preferably, the tab is formed as a unitary body on the end of a strap 168 which is sewn, or otherwise attached, to and extends from the finger tip of each finger of the handpiece 102.

The port 150 communicates with the finger receiving cavity 162 through an interposed passageway 170. The passageway 170 is a generally axial extension of the finger cavity 162 and is oriented generally transversely to the axis of the port 150. The tab is wedge shaped and it and the strap 168 conformingly and matingly fit within the passageway 170 and the port 150. The tab 164, like the rib 146 and the skin 144, is formed of a flexible, resilient material so that all these structures may be bent and distorted to allow the tab to be manually forced in an axial direction from the finger-receiving cavity 162 through the passageway 170 into the port 150. The wedge shape of the tab facilitates this insertion into the port 150 where the tab is conformingly and matingly held to hold the finger of the handpiece in position. The handpiece may be removed by similar bending of these materials and withdrawal of the tab.

A generally conventional button-like structure may be utilized to retain the rear and heel portion of the handpiece 102 within the shell 100. For this purpose a first button 172 is sewn to the back of the handpiece 102 at the base of the thumb 159. Similarly, a second button 174 is sewn at the base of the little finger. A third button 176 is sewn to the front heel portion of the handpiece 102. Suitable button hole slits (as illustrated by buttonhole 200 of FIG. 12) are formed through the skin 144 in the corresponding regions of the shell 100 for insertion and retention of the buttons securing the handpiece 102 to the shell 100.

Various alternatives in detailed additional enhancements may be incorporated into embodiments of the invention. For example, the ribs may be interconnected together by a small band, cord or thread of material to help properly position and retain the ribs in the mold during the molding process. The finger-receiving cavity for receipt of the small finger of the handpiece and the small finger of the user's hand may be made extra wide for the convenience of those who prefer to position two fingers in that position of the glove. A hole or other opening may be formed in the back surface of the handpiece 102 and at an appropriate position through the skin 144 to allow those who prefer to permit their index finger to protrude behind the entire glove. Additional padding may be sewn upon the palm surface of the handpiece and is preferably a neoprene padding having small holes or foam-like in nature.

Additional frontal surface ventilation passages 180 are formed through the ribs 140 and corresponding ventilation passages 182 are formed through the skin 144 in registration with the rib ventilation passages 180. These passages not only improve air ventilation for all five fingers of the user in the finger receiving cavities, but they also allow the mold, which is used to mold the skin 144, to have regions of mold's component parts make contact with each other through these passages during the skin molding process. This contact allows the mold parts to support each other and thus assures more consistently, accurate dimensions for the finished molded product.

While certain preferred embodiments of the present invention have been disclosed in detail, it is to be understood that various modifications may be adopted without departing from the spirit of the invention or scope of the following claims.

We claim:

1. A ball glove having a concave, frontal, ball receiving surface, a proximal edge adjacent a hand-receiving opening leading to finger-receiving cavities aligned in a general axial direction and having an opposite, generally laterally extending, peripheral, distal edge, the glove including:

a plurality of generally axially oriented ridges protruding outwardly from the frontal surface and extending to near the distal edge, the ridges further including ball retaining protrusions extending outwardly from the ridges further than contiguous portions of the ridges and having a shoulder formed at the proximal ends of the protrusions.

2. A ball glove in accordance with claim 1 wherein the protrusions taper at their distal ends toward the distal peripheral edge of the glove.

3. A glove in accordance with claim 1 wherein the frontal surface has a palm portion and a finger portion and wherein the ridges extend along approximately the entire finger portion for each of a plurality of fingers.

4. A glove in accordance with claim 3 wherein the ridges extend across the palm portion to approximately the proximal edge.

5. A ball glove in accordance with claim 1 wherein the protrusions taper at their distal ends toward the distal peripheral edge of the glove.

6. A ball glove having a concave, frontal, ball receiving surface, an opposite convex rear surface, a proximal edge adjacent a hand-receiving opening adjoining finger-receiving cavities and a thumb cavity aligned in a generally axial direction, and having an opposite, generally laterally extending peripheral distal edge, the frontal surface having a palm region, a thumb region, a finger region and a web region extending between the thumb region and the finger region, the glove comprising:

(a) a plurality of generally axially oriented, flexible, elongated reinforcing ribs in the thumb and finger regions of the glove, the ribs having a cured surface contour;

(b) a skin which is formed of a more flexible material than the ribs, the skin extending frontally of, conformingly attached to and interconnecting the ribs and forming the frontal surface of the glove, the hand-receiving opening, and the finger-receiving cavities of the glove.

7. A ball glove in accordance with claim 6 wherein the skin is an elastomeric resin polymer conformingly surrounding the ribs and there is a rib associated with each finger and thumb region, a rib being positioned frontally of each finger and thumb cavity.

8. A ball glove in accordance with claim 7 wherein a plurality of generally axially oriented ridges protrude outwardly from the frontal surface and extend to near the distal edge of the glove.

9. A ball glove in accordance with claim 8, wherein the ridges further include ball retaining protrusions extending outwardly further than contiguous portions of the ridges and having a shoulder formed at the proximal ends of the protrusions.

10. A ball glove in accordance with claim 9 wherein the protrusions taper at their distal ends toward the distal peripheral edge of the glove.

11. A ball glove in accordance with claim 10 wherein the ridges extend along approximately the entire finger region and along the thumb region.

12. A glove in accordance with claim 11 wherein the ridges extend across the palm portion to approximately the proximal edge.

13. A glove in accordance with claim 7 wherein the skin has flex enhancing corrugations formed along an interconnection region between the web region and the finger region of the glove.

14. A glove in accordance with claim 13 wherein said corrugations extend in a smoothly curved U-shape from the distal peripheral edge to the palm region and back to the distal peripheral edge.

15. A glove in accordance with claim 7 wherein the skin has a plurality of slits through the skin and spaced between each finger cavity for enhancing lateral flexibility.

16. A glove in accordance with claim 15 wherein the sidemost ribs for the thumb and the little finger are less flexible than the other ribs.

17. A glove in accordance with claim 16 wherein the ribs are progressively more flexible in progression from the sidemost little finger rib to the rib adjacent the web.

18. A glove in accordance with claim 7 wherein a plurality of elongated ventilation passages are formed through the frontal surface of the skin in the palm region and oriented in a generally axial direction.

19. A glove in accordance with claim 7 wherein each finger cavity is a pocket and a plurality of elongated ventilation passages are formed through the rear surface into each finger pocket.

20. A glove in accordance with claims 7 wherein a plurality of elongated ventilation passages are formed through the frontal surface of the skin and through the ribs opening into the finger receiving cavities.

21. A glove in accordance with claim 7 wherein a hand-receiving, glove-like handpiece, having a thumb and fingers, is detachably mounted to the skin at the hand-receiving opening and extends into the finger-receiving cavities.

22. A glove in accordance with claim 21 wherein ports are formed through the skin and ribs, a port communicating from the frontal surface to each finger-receiving cavity, wherein a button-like tab is attached to the end of each finger and the thumb of the handpiece, and wherein the handpiece is mounted to the assembled skin and ribs by said tabs being positioned in the ports.

23. A glove in accordance with claim 22 wherein each port is formed into the frontal surface and communicates to a finger-receiving cavity through a passageway which is a generally axial extension of the finger cavity oriented generally transverse to the axis of the port and the tab is formed on the end of a strap attached to and extending from a fingertip of the glove-like handpiece and is positioned in the passageway.

24. A glove in accordance with claim 23 wherein the tab is wedge shaped and conformingly and matingly fits in the passageway and the port.

25. A glove in accordance with claim 21 wherein the thumb and little finger-receiving cavities are pockets, wherein a button hole is formed through the rear wall of the pockets and wherein a pair of spaced buttons are attached to a rear surface of the handpiece and engaged in said button holes.

26. A ball glove in accordance with claim 6 wherein the ribs have a durometer hardness substantially within the range from 65 on the shore A durometer hardness scale to 65 on the shore D durometer hardness scale and the skin has a durometer hardness substantially within the range from 45–70 on the Shore A durometer hardness scale.

27. A ball glove in accordance with claim 26 where the ribs have a durometer hardness substantially within the range of 80–100 on the shore A durometer hardness scale and the skin has a durometer hardness substantially within the range of 45–60 on the shore A durometer hardness scale.

28. A ball glove in accordance with claim 6 wherein:

(a) a plurality of generally axially oriented ridges protrude outwardly from the frontal surface and extend to near the distal edge of the glove the ridges including ball retaining protrusions extending outwardly further than contiguous portions of the ridges and having a shoulder formed at the proximal ends of the protrusions and a taper at their distal ends tapering toward the distal peripheral edge of the glove;

(b) the skin has flex enhancing corrugations formed along an interconnection region between the web region and the finger region of the glove the corrugations extending in a smoothly curved U-shape from the distal peripheral edge to the palm region and back to the distal peripheral edge; and (c) the skin has a plurality of slits through the skin spaced between each finger cavity for enhancing lateral flexibility.

29. A ball glove in accordance with claim 28 wherein:

(a) the sidemost ribs for the thumb and the little finger are less flexible than the other ribs; and (b) a hand-receiving, glove-like handpiece, having a thumb and fingers, is detachably mounted to the skin at the hand-receiving opening and extends into the finger-receiving cavities.

* * * * *